US005217857A

United States Patent [19]

Hayashi

[11] Patent Number: 5,217,857

[45] Date of Patent: Jun. 8, 1993

[54] GOLD SENSITIZED SILVER HALIDE COLOR PHOTOGRAPHIC MATERIAL CONTAINING A YELLOW COUPLER

[75] Inventor: Yasuhiro Hayashi, Kanagawa, Japan

[73] Assignee: Fuji Photo Film Co., Ltd., Kanagawa, Japan

[21] Appl. No.: 639,864

[22] Filed: Jan. 11, 1991

[30] Foreign Application Priority Data

Jan. 12, 1990 [JP] Japan ..... 2-4903

[51] Int. Cl.[5] ..... G03C 1/09; G03C 7/36

[52] U.S. Cl. ..... 430/556; 430/557; 430/567; 430/603; 430/605

[58] Field of Search ..... 430/523, 961, 556, 557, 430/603, 605, 567

[56] References Cited

U.S. PATENT DOCUMENTS

| | | | |
|---|---|---|---|
| 4,917,994 | 4/1990 | Martinez et al. | 430/543 |
| 5,024,932 | 6/1991 | Tanji et al. | 430/567 |
| 5,035,988 | 7/1991 | Nakamura et al. | 430/551 |
| 5,070,003 | 12/1991 | Naruse et al. | 430/389 |

FOREIGN PATENT DOCUMENTS

| | | | |
|---|---|---|---|
| 0327976 | 8/1989 | European Pat. Off. | 430/557 |

*Primary Examiner*—Lee C. Wright

*Attorney, Agent, or Firm*—Sughrue, Mion, Zinn, Macpeak & Seas

[57] ABSTRACT

A silver halide color photographic material comprising a support having thereon one or more layers having a surface pH of 5.0 to 6.5, including at least one silver halide emulsion layer containing a gold-sensitized silver halide emulsion having a silver chloride content of at least 90 mol % and a coupler represented by formula (I):

(I)

wherein $R_1$ represents an aryl group or a tertiary alkyl group; $R_2$ represents fluorine, an alkyl group, an aryl group, an alkoxy group, an aryloxy group, a dialkylamino group, an alkylthio group or an arylthio group; $R_3$ is a group which is substituted for a hydrogen atom on the benzene ring; X represents hydrogen or a group capable of being cleaved upon a coupling reaction with an oxidation product of an aromatic primary amine developing agent; and l is 0 or an integer from 1 to 4.

The silver halide color photographic material is excellent in color reproducibility and has high sensitivity and a good rapid processing aptitude, and is particularly suitable for a color printing material.

20 Claims, No Drawings

GOLD SENSITIZED SILVER HALIDE COLOR PHOTOGRAPHIC MATERIAL CONTAINING A YELLOW COUPLER

FIELD OF THE INVENTION

The present invention relates to a silver halide color photographic material having good color reproducibility, high sensitivity and good rapid processing aptitude, and more particularly, to a silver halide color photographic material for a color print.

BACKGROUND OF THE INVENTION

With popularization of color photographic light-sensitive materials, it has become important to conduct color development processing rapidly, and to provide images of high quality.

In response to these requirements, various investigations of rapid processing for improvement in image quality, particularly improvement in color reproducibility, have been made with respect to photographic light-sensitive materials for color prints.

It is known that a silver chloride emulsion which has a high silver chloride content is preferably employed as a silver halide emulsion for rapid processing, as described, for example, in International Patent Application (Laid Open) No. WO 87/04534 and JP-A-64-26837 (the term "JP-A" as used herein means an "unexamined published Japanese patent application").

Various investigations have also been made for improvement in color reproducibility. In particular, with respect to photographic light-sensitive materials for color prints, many attempts for improving the absorption spectra of cyan, magenta and yellow colored dyes form colors have been made. For instance, pyrazoloazole type magenta couplers have been developed that are preferred from the standpoint of bright reproduction of magenta, red and blue series colors because they provide colored dyes by a coupling reaction with an oxidation product of a developing agent, whose absorption spectra do not have subsidiary absorption in the short wavelength side and are very sharp, in comparison with 5-pyrazolone type magenta couplers conventionally employed. These are described in detail, for example, in U.S. Pat. Nos. 4,500,630 and 4,540,654, JP-A-61-65245, JP-A-61-65246, JP-A-61-147254, and European Patent (OPI) Nos. 226,849 and 294,785.

Further, in connection with yellow couplers, many attempts for improving color reproduction by reducing undesirable absorption in the magenta side wavelength, by varying the kinds and positions of substituents in comparison with those conventionally employed as described, for example, in JP-A-63-123047, and JP-A-63-241547.

When using these yellow couplers, however, it is necessary to employ them in relatively high content and hard gradation as compared with conventional yellow couplers, since the dyes formed have low visual sensitivity for human eyes. When these yellow couplers are employed in silver halide color photographic materials for rapid processing having a high silver chloride content, sufficiently high gradation and color density are not always obtained. Particularly, when these photographic materials are subjected to continuous development processing, as the amount of the photographic materials processed increases, sensitivity and gradation are remarkably decreased, causing a large problem in practical use.

SUMMARY OF THE INVENTION

An object of the present invention is to provide a silver halide color photographic material which is excellent in color reproducibility, which has high sensitivity and which has a good rapid processing aptitude.

Another object of the present invention is to provide a silver halide color photographic material for a color print.

Other objects of the present invention will become apparent from the following detailed description and examples.

As a result of intensive investigations, it has now been found that these and other objects of the present invention are accomplished with a silver halide color photographic material comprising a support having thereon one or more layers having a surface pH of 5.0 to 6.5, said layers comprising at least one silver halide emulsion layer comprising a gold-sensitized silver halide emulsion having a silver chloride content of at least 90 mol % and at least one coupler represented by formula (I).

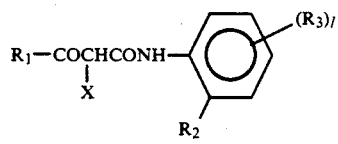

(I)

wherein $R_1$ represents an aryl group or a tertiary alkyl group; $R_2$ represents fluorine, an alkyl group, an aryl group, an alkoxy group, an aryloxy group, a dialkylamino group, an alkylthio group or an arylthio group; $R_3$ represents a group which is substituted for a hydrogen atom on the benzene ring; X represents hydrogen or a group capable of being cleaved upon a coupling reaction with an oxidation product of an aromatic primary amine developing agent; and l represents 0 or an integer of 1 to 4, provided that plural $R_3$ groups may be the same or different.

DETAILED DESCRIPTION OF THE INVENTION

The coupler represented by formula (I) employed in the present invention is now described in more detail.

In formula (I), the aryl group or the tertiary alkyl group for $R_1$ may be substituted by an alkyl group, an aryl group, a halogen, an alkoxy group or an aryloxy group. $R_1$ preferably represents an aryl group having from 6 to 24 carbon atoms (for example, phenyl, p-tolyl, o-tolyl, 4-methoxyphenyl, 2-methoxyphenyl, 4-butoxyphenyl, 4-octyloxyphenyl, 4-hexadecyloxyphenyl, or 1-naphthyl) or a tertiary alkyl group having from 4 to 24 carbon atoms (for example, tert-butyl, tert-pentyl, tert-hexyl, 1,1,3,3-tetramethylbutyl, 1-adamantyl, 1,1-dimethyl-2-chloroethyl, 2-phenoxy-2-propyl, or bicyclo[2,2,2]octane-1-yl).

In formula (I), the alkyl, aryl, alkoxy, aryloxy, dialkylamino, alkylthio or arylthio group for $R_2$ may be substituted by an alkyl group, an aryl group, a halogen, an alkoxy group, an aryloxy group or an amino group and $R_2$ preferably represents fluorine, an alkyl group having from 1 to 24 carbon atoms (for example, methyl, ethyl, isopropyl, tert-butyl, cyclopentyl, n-octyl, n-hexadecyl, or benzyl), an aryl group having from 6 to 24 carbon atoms (for example, phenyl, p-tolyl, o-tolyl, or 4-methoxyphenyl}, an alkoxy group having from 1 to 24 carbon atoms (for example, methoxy, ethoxy, butoxy, n-octyloxy, n-tetradecyloxy, benzyloxy, or methoxyethoxy), an aryloxy group having from 6 to 24 carbon atoms (for example, phenoxy, p-tolyloxy, o-tolyloxy, p-methoxyphenoxy, p-dimethylaminophenoxy, or m-pentadecylphenoxy), a dialkylamino group having from 2 to 24 carbon atoms (for example, dimethylamino, diethylamino, pyrrolidino, piperidino, or morpholino), an alkylthio group having from 1 to 24 carbon atoms (for example, methylthio, butylthio, n-octylthio, or n-hexadecylthio, or an arylthio group having from 6 to 24 carbon atoms (for example, phenylthio, 4-methoxyphenylthio, 4-tert-butylphenylthio, or 4-dodecylphenylthio).

In formula (I), R3 preferably represents a halogen, an alkyl group, an aryl group, an alkoxy group, an aryloxy group, an alkoxycarbonyl group, an aryloxycarbonyl group, a carbonamido group, a sulfonamido group, a carbamoyl group, an alkylsulfonyl group, an arylsulfonyl group, a ureido group, a sulfamoylamino group, an alkoxycarbonylamino group, a nitro group, a heterocyclic group, a cyano group, an acyl group, an acyloxy group, an alkylsulfonyloxy group, or an arylsulfonyloxy group. These groups may be substituted by a halogen, an alkoxy group, an aryloxy group, an alkylsulfonyl group, an arylsulfonyl group, an alkoxycarbonyl group, an acyl group or an acyloxy group. In more detail $R_3$ represents a halogen (for example, fluorine, chlorine, bromine, or iodine), an alkyl group having from 1 to 24 carbon atoms (for example, methyl, tert-butyl, or n-dodecyl), an aryl group having from 6 to 24 carbon atoms (for example, phenyl, p-tolyl, or p-dodecyloxyphenyl), an alkoxy group having from 1 to 24 carbon atoms (for example, methoxy, n-butoxy, n-octyloxy, n-tetradecyloxy, benzyloxy, or methoxyethoxy), an aryloxy group having from 6 to 24 carbon atoms (for example, phenoxy, p-tert-butylphenoxy, or 4-butoxyphenoxy), an alkoxycarbonyl group having from 2 to 24 carbon atoms (for example, ethoxycarbonyl, dodecyloxycarbonyl, or 1-(dodecyloxycarbonyl)ethoxycarbonyl), an aryloxycarbonyl group having from 7 to 24 carbon atoms (for example, phenoxycarbonyl, 4-tert-octylphenoxycarbonyl, or 2,4-di-tert-pentylphenoxycarbonyl), a carbonamido group having from 1 to 24 carbon atoms (for example, acetamido, pivaloylamino, benzamido, 2-ethylhexanamido, tetradecanamido, 1-(2,4-di-tert-pentylphenoxy)butanamido, 3-(2,4-di-tert-pentylphenoxy)butanamido, or 3-dodecylsulfonyl-2-methylpropanamido), a sulfonamido group having from 1 to 24 carbon atoms (for example, methanesulfonamido, p-toluenesulfonamido, or hexadecanesulfonamido), a carbamoyl group having from 1 to 24 carbon atoms (for example, N-methylcarbamoyl, N-tetradecylcarbamoyl, N,N-dihexylcarbamoyl, N-octadecyl-N-methylcarbamoyl, or N-phenylcarbamoyl), an alkylsulfonyl group having from 1 to 24 carbon atoms (for example, methylsulfonyl, benzylsulfonyl, or hexadecylsulfonyl), an arylsulfonyl group having from 6 to 24 carbon atoms (for example, phenylsulfonyl, p-tolylsulfonyl, p-dodecylsulfonyl, or p-methoxysulfonyl), a ureido group having from 1 to 24 carbon atoms (for example, 3-methylureido, 3-phenylureido, 3,3-dimethylureido, or 3-tetradecylureido), a sulfamoylamino group having from 0 to 24 carbon atoms (for example, N,N-dimethylsulfamyolamino), an alkoxycarbonylamino group having from 2 to 24 carbon atoms (for example, methoxycarbonylamino, isobutoxycarbonylamino, or dodecyloxycarbonylamino), a nitro group, a heterocyclic group having from 1 to 24 carbon atoms (for example, 4-pyridyl, 2-thienyl, phthalimido, or octadecylsuccinimido), a cyano group, an acyl group having from 1 to 24 carbon atoms (for example, acetyl, benzoyl, or dodecanoyl), an acyloxy group having from 1 to 24 carbon atoms (for example, acetoxy, benzoyloxy, or dodecanoyloxy), an alkylsulfonyloxy group having from 1 to 24 carbon atoms (for example, methylsulfonyloxy, or hexadecylsulfonyloxy), or an arylsulfonyloxy group having from 6 to 24 carbon atoms (for example, p-toluenesulfonyloxy, or p-dodecylphenylsulfonyloxy)

In formula (I), l preferably is 1 or 2.

In formula (I), X preferably represents a group capable of being cleaved upon a coupling reaction with an oxidation product of an aromatic primary amine developing agent ("coupling-off" group) and includes halogen (for example, fluorine, chlorine, bromine, or iodine), a heterocyclic group having from 1 to 24 carbon atoms which is connected to the coupling active position by a nitrogen included therein, an aryloxy group having from 6 to 24 carbon atoms, an arylthio group having from 6 to 24 carbon atoms (for example, phenylthio, p-tert-butylphenylthio, p-chlorophenylthio, or p-carboxyphenylthio), an acyloxy group having from 1 to 24 carbon atoms (for example, acetoxy, benzoyloxy, or dodecanoyloxy), an alkylsulfonyloxy group having from 1 to 24 carbon atoms (for example, methylsulfonyloxy, butylsulfonyloxy, or dodecylsulfonyloxy), an arylsulfonyloxy group having from 6 to 24 carbon atoms (for example, benzenesulfonyloxy, or p-chlorophenylsulfonyloxy), or a heterocyclicoxy group having from 1 to 24 carbon atoms (for example, 3-pyridyloxy, or 1-phenyl-1,2,3,4-tetrazol-5-yloxy), and more preferably represents a heterocyclic group which is connected to the coupling active position by the nitrogen included therein, or an aryloxy group.

The heterocyclic group which is connected to the coupling active position by the nitrogen atom represented by X is preferably a 5-membered to 7-membered heterocyclic group which may be monocyclic or condensed, may contain one or more hetero atoms selected from oxygen, sulfur, nitrogen, phosphorus, selenium and tellurium in addition to nitrogen, and may be substituted. Suitable examples of the heterocyclic ring include succinimide, maleinimide, phthalimide, diglycolimide, pyrrole, pyrazole, imidazole, 1,2,4-triazole, tetrazole, indole, benzopyrazole, benzimidazole, benzotriazole, imidazolidine-2,4-dione, oxazolidine-2,4-dione, thiazolidine-2,4-dione, imidazolin-2-one, oxazolin-2-one, thiazolin-2-one, benzimidazolin-2-one, benzoxazolin-2-one, benzothiazolin-2-one, 2-pyrrolin-5-one, 2-imidazolin-5-one, indoline-2,3-dione, 2,6-dioxypurine, parabanic acid, 1,2,4-triazolidine-3,5-dione, 2-pyridone, 4-pyridone, 2-pyrimidone, 6-pyridazone, and 2-pyrazone.

Suitable examples of the substituents for the heterocyclic group include a hydroxy group, a carboxyl group, a sulfo group, and an amino group (for example, amino, N-methylamino, N,N-dimethylamino, N,N-diethylamino, anilino, pyrrolidino, piperidino, or morpholino), in addition to the substituents for $R_3$ described above.

The aryloxy group represented by X is preferably an aryloxy group having from 6 to 24 carbon atoms, which may be substituted with one or more substituents selected from those described for the heterocyclic group represented by X above. Of the substituents, a carboxyl group, a sulfo group, a cyano group, a nitro group, an alkoxycarbonyl group, a halogen atom, a carbonamido group, a sulfonamido group, a carbamoyl group, a sulfamoyl group, an alkyl group, an alkylsulfonyl group, an arylsulfonyl group and an acyl group are preferred.

Examples of particularly preferred substituents represented by $R_1$, $R_2$, $R_3$ and X in formula (I) in the present invention are now illustrated.

In formula (I), $R_1$ is particularly preferably a 2- or 4-alkoxyaryl group (for example, 4-methoxyphenyl, 4-butoxyphenyl, or 2-methoxyphenyl) or a tert-butyl group. Most preferably, $R_1$ is a tert-butyl group.

In formula (I), $R_2$ is more preferably methyl, ethyl, an alkoxy group, an aryloxy group or a dialkylamino group. Particularly preferably, $R_2$ is methyl, ethyl, an alkoxy group, an aryloxy group or a dimethylamino group and most preferably $R_2$ is an alkoxy group having from 1 to 4 carbon atoms.

In formula (I), $R_3$ is most preferably an alkoxy group, a carbonamido group or a sulfonamido group and particularly preferably a carbonamido group.

In formula (I), X is particularly preferably a heterocyclic group connected to the coupling active position by a nitrogen contained therein or an aryloxy group.

The heterocyclic group reprsented by X is more preferably a group represented by formula (II):

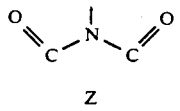

(II)

Z wherein Z represents

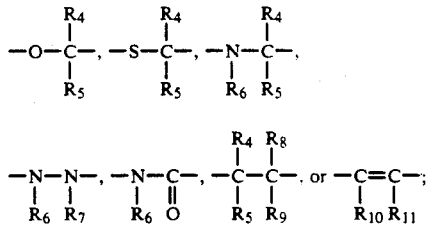

wherein $R_4$, $R_5$, $R_8$ and $R_9$, which may be the same or different, each represents hydrogen, an alkyl group, an aryl group, an alkoxy group, an aryloxy group, an alkylthio group, an arylthio group, an alkylsulfonyl group, an arylsulfonyl group or an amino group; $R_6$ and $R_7$, which may be the same or different, each represents a halogen, an alkyl group, an aryl group, an alkylsulfonyl group, an arylsulfonyl group or an alkoxycarbonyl group; $R_{10}$ and $R_{11}$, which may be the same or different, each represents hydrogen, an alkyl group or an aryl group, and $R_{10}$ and $R_{11}$ may combine with each other to form a benzene ring; and $R_4$ and $R_5$, $R_5$ and $R_6$, $R_6$ and $R_7$ or $R_4$ and $R_8$ may combine with each other to form a ring (for example, cyclobutane, cyclohexane, cycloheptane, cyclohexene, pyrrolidine, or piperidine).

Of the heterocyclic groups represented by formula (II), those represented by formula (II) wherein Z is

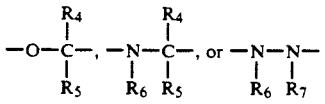

are particularly preferred.

The total number of carbon atoms included in the heterocyclic group represented by formula (II) is generally from 2 to 24, preferably from 4 to 20, more preferably from 5 to 16.

Suitable examples of the heterocyclic group represented by formula (II) include a succinimido group, a maleinimido group, a phthalimido group, a 1-methylimidazolidine-2,4-dion-3-yl group, a 1-benzylimidazolidine-2,4-dion-3-yl group, a 5,5-dimethyloxazolidine-2,4-dion-3-yl group, a 5-methyl-5-propyloxazolidine-2,4-dion-3-yl group, a 5,5-dimethylthiazolidine-2,4dion-3-yl group, a 5,5-dimethylimidazolidine-2,4-dion-3-yl group, a 3-methylimidazolidinetrion-1-yl group, a 1,2,4-triazolidine-3,5-dion-4-yl group, a 1-methyl-2-phenyl-1,2,4-triazolidine-3,5-dion-4 yl group, a 1-benzyl-2-phenyl-1,2,4-triazolidine-3,5-dion-4-yl group, a 5-hexyloxy-1-methylimidazolidine-2,4-dion-3-yl group, a 1-benzyl-5-ethoxyimidazolidine-2,4-dion-3-yl group, and a 1-benzyl-5-dodecyloxyimidazolidine-2,4-dion-3-yl group.

Among these heterocyclic groups, an imidazolidine-2,4-dion-3-yl group (for example, 1-benzyl-1-imidazolidine-2,4-dion-3-yl) is most preferred.

Particularly preferred examples of the aryloxy group represented by X include a 4-carboxyphenoxy group, a 4-methylsulfonylphenoxy group, a 4-(4-benzyloxyphenylsulfonyl)phenoxy group, a 4-(4-hydroxyphenylsulfonyl)phenoxy group, a 2-chloro-4-(3-chloro-4-hydroxyphenylsulfonyl)phenoxy group, a 4-methoxycarbonylphenoxy group, a 2-chloro-4-methoxycarbonylphenoxy group, a 2-acetamido-4-methoxycarbonylphenoxy group, a 4-isopropoxycarbonylphenoxy group, a 4-cyanophenoxy group, a 2-[N-(2-hydroxyethyl)carbamoyl]phenoxy group, a 4-nitrophenoxy group, a 2,5-dichlorophenoxy group, a 2,3,5-trichlorophenoxy group, a 4-methoxycarbonyl-2-methoxyphenoxy group, and a 4-(3-carboxypropanamido)-phenoxy group.

The coupler represented by formula (I) may form a polymer, including a dimer or higher oligomer connected through a di- or higher valent group at the substituent represented by $R_1$, X or

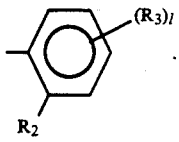

In such cases, the range of carbon atoms defined for each substituent is not restricted.

Typical examples of polymer couplers formed from the coupler represented by formula (I) are a homopolymer and a copolymer each containing a monomer unit of an addition-polymerizable ethylenically unsaturated compound having a yellow dye forming coupler residue (a yellow color forming monomer). More specifically, the polymer contains a yellow color forming repeating unit represented by formula (III) described below. A copolymer containing one or more kinds of yellow color forming repeating units represented by formula (III) and a copolymer containing one or more kinds of non-color forming ethylenic monomers as comonomer components, are also within the scope of the invention.

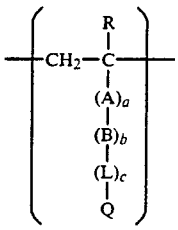

(III)

wherein R represents hydrogen, an alkyl group having from 1 to 4 carbon atoms or chlorine; A represents —CONH—, —COO— or a substituted or unsubstituted phenylene group; B represents a substituted or unsubstituted alkylene group, a substituted or unsubstituted phenylene group or a substituted or unsubstituted aralkylene group; L represents —CONH—, —NHCONH—, —NHCOO—, —NHCO—, —OCONH—, —NH—, —COO—, —OCO—, —CO—, —O—, S, $—SO_2—$, $—NHSO_2—$, or $—SO_2NH—$; a, b and c each is 0 or 1; and Q represents a yellow coupler moiety formed by removing a hydrogen atom from $R_1$, X or

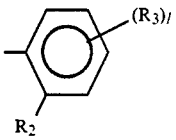

of the compound represented by formula (I).

Of the polymers, copolymers composed of a yellow color forming monomer which provides a coupler unit represented by formula (III) and a non-color forming ethylenic monomer described below are preferred.

Suitable examples of the non-color forming ethylenic monomer which is incapable of coupling with the oxidation product of an aromatic primary amine developing agent include an acrylic acid (for example, acrylic acid, an α-chloroacrylic acid, or an α-alkylacrylic acid such as methacrylic acid), an ester or amide derived from an acrylic acid (for example, acrylamide, methacrylamide, n-butylacrylamide, tert-butylacrylamide, diacetoneacrylamide, methyl acrylate, ethyl acrylate, n-propylacrylate, n-butyl acrylate, tert-butyl acrylate, isobutyl acrylate, 2-ethylhexyl acrylate, n-octyl acrylate, lauryl acrylate, methyl methacrylate, ethyl methacrylate, n-butyl methacrylate, or β-hydroxyethyl methacrylate), a vinyl ester (for example, vinyl acetate, vinyl propionate, or vinyl laurate), acrylonitrile, metharylonitrile, an aromatic vinyl compound (for example, styrene and a derivative thereof, for example, vinyl toluene, divinyl benzene, vinyl acetophenone, or sulfo styrene), itaconic acid, citraconic acid, crotonic acid, vinylidene chloride, a vinyl alkyl ether (for example, vinyl ethyl ether), an ester of maleic acid, N-vinyl-2-pyrrolidone, N-vinyl pyridine, and 2- or 4-vinyl pyridine.

Of these monomers, an ester of acrylic acid, an ester of methacrylic acid and an ester of maleic acid are particularly preferred.

Two or more non-color forming ethylenic monomers as described above can be used together. For example, a combination of methyl acrylate and butyl acrylate, butyl acrylate and styrene, butyl methacrylate and methacrylic acid, or methyl acrylate and diacetoneacrylamide can be used.

The ethylenically unsaturated monomer which is copolymerized with the vinyl monomer corresponding to the repeating unit represented by formula (III) can be selected so that the copolymer formed possesses good physical properties and/or chemical properties, for example, solubility, compatibility with a binder such as gelatin in a photographic colloid composition, flexibility, or heat stability, as is well known in the field of polymer couplers.

The yellow polymer coupler according to the present invention can be synthesized in accordance with the synthesizing methods disclosed, for example, in JP-A-58-42044, JP-A-62-141552, JP-A-62-276548, JP-A-63-30855 and JP-A-2-108046.

The yellow polymer coupler used in the present invention can be prepared by dissolving an oleophilic polymer coupler obtained by polymerization of a vinyl monomer including the coupler unit represented by formula (III) described above, in an organic solvent and then dispersing the solution in a latex form in an aqueous solution of gelatin or directly by an emulsion polymerization method.

When an oleophilic polymer coupler is dispersed in a latex form in an aqueous gelatin solution, the method described in U.S. Pat. No. 3,451,820 can be used. When an emulsion polymerization method is employed, the method described in U.S. Pat. Nos. 4,080,211 and 3,370,952 can be used.

Specific examples of $R_3$ and X of the yellow dye forming couplers represented by formula (I) are set forth below, but the present invention is not to be construed as being limited thereto.

Specific Examples of X:

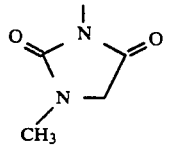

(1)

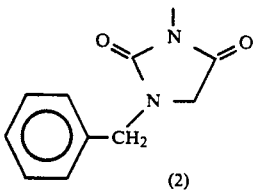

(2)

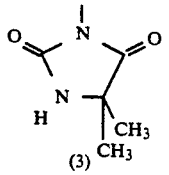

(3)

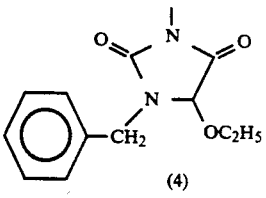

(4)

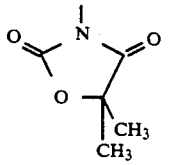

(5)

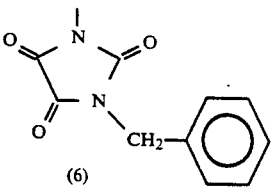

(6)

-continued
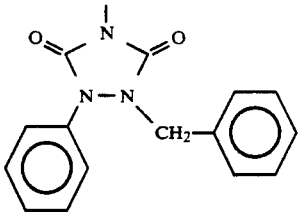
(7)
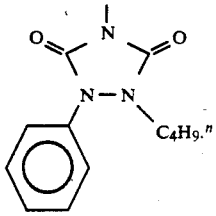
(8)
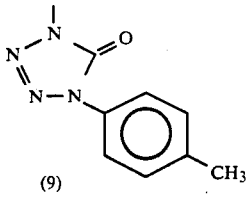
(9)
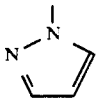
(10)
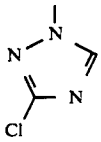
(11)
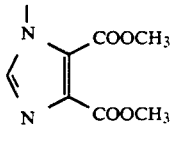
(12)
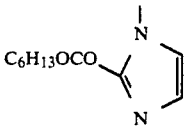
(13)
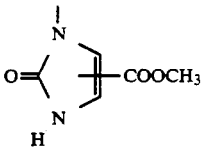
(14)
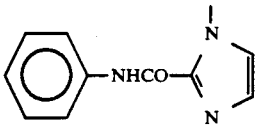
(15)
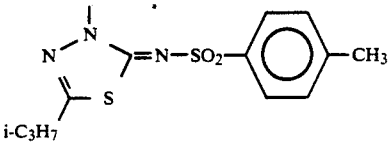
(16)
-continued
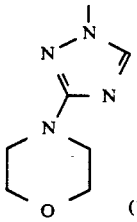
(17)
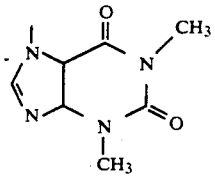
(18)
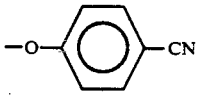
(19)
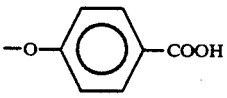
(20)
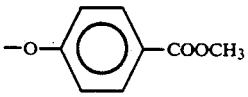
(21)
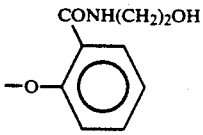
(22)
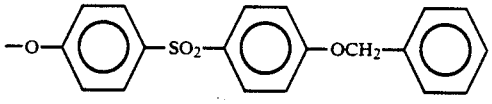
(23)
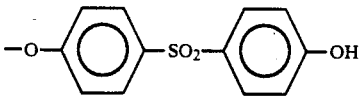
(24)
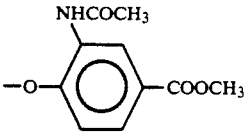
(25)
Specific Examples of $R_3$:
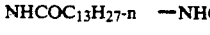
(30)
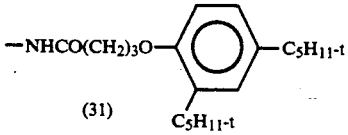
(31)
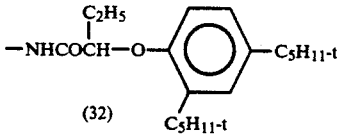
(32)
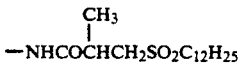
(33)

-continued

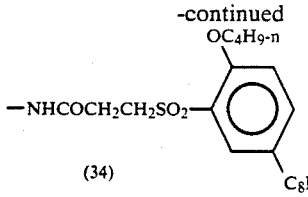

(34)

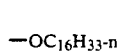

(35)

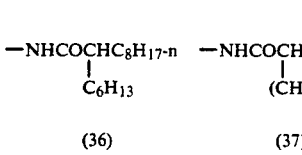

(36)

(37)

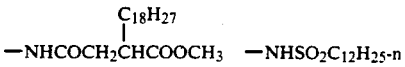

(38)

(39)

-continued

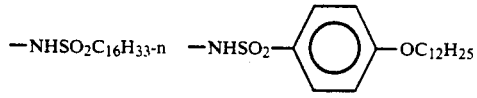

(40)

(41)

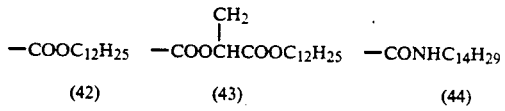

(42)

(43)

(44)

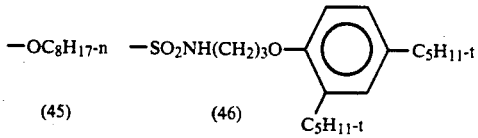

(45)

(46)

Specific examples of the yellow dye forming coupler represented by formula (I) are set forth below, but the present invention is not to be construed as being limited thereto. In formula (I) preferred positions of substitution for the group $R_3$ is the 4- or 5-position.

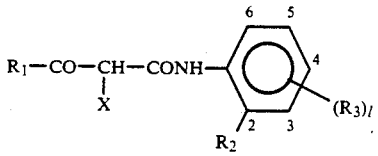

| No. | $R_1$ | $R_2$ | $(R_3)_l$ | X |
|---|---|---|---|---|
| Y-1 | t-$C_4H_9$— | —$OCH_3$ | (32) [5] | (4) |
| Y-2 | t-$C_4H_9$— | —$OCH_3$ | (32) [5] | (5) |
| Y-3 | t-$C_4H_9$— | —$CH_3$ | (31) [5] | (2) |
| Y-4 | t-$C_4H_9$— | 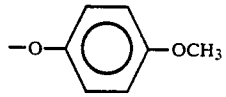 | (32) [5] | (5) |
| Y-5 | t-$C_4H_9$— | 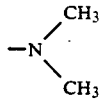 | (32) [5] | (4) |
| Y-6 | t-$C_4H_9$— | —$OCH_3$ | (33) [5] | (8) |
| Y-7 | t-$C_4H_9$— | —$OC_2H_5$ | (33) [5] | (7) |
| Y-8 | t-$C_4H_9$— | —$OCH_3$ | (31) [5] | (23) |
| Y-9 | t-$C_4H_9$— | 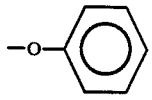 | (40) [5] | (19) |
| Y-10 | t-$C_4H_9$— | —$OC_8H_{17}$-n | (45) [4] | (5) |
| Y-11 | t-$C_4H_9$— | —$OC_8H_{17}$-n | (45) [5] | (5) |
| Y-12 | t-$C_4H_9$— | —$OCH_3$ | (42) [5] | (4) |
| Y-13 | t-$C_4H_9$— | 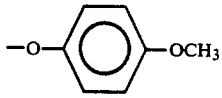 | (30) [5] | (10) |
| Y-14 | t-$C_4H_9$— | —$OC_{16}H_{33}$-n | — | (15) |
| Y-15 | t-$C_4H_9$— | —$OCH_2CH_2OCH_3$ | (34) [5] | (8) |
| Y-16 | t-$C_4H_9$— | —$CH_3$ | (43) [5] | (9) |
| Y-17 | t-$C_4H_9$— | —$C_2H_5$ | (47) [5] | (8) |
| Y-18 | t-$C_4H_9$— | —$OCH_3$ | (46) [5] | (2) |
| Y-19 | t-$C_4H_9$— | —$OC_8H_{17}$-n | (45) [4], (45) [5] | (5) |
| Y-20 | t-$C_4H_9$— | —$OCH_3$ | (31) [5] | (19) |

-continued
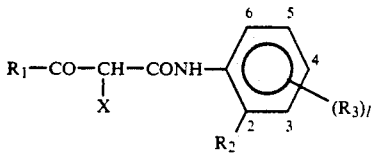
| No. | $R_1$ | $R_2$ | $(R_3)_l$ | X |
|---|---|---|---|---|
| Y-21 | t-$C_4H_9$— | —N(CH$_3$)$_2$ | (36) [4] | (18) |
| Y-22 | t-$C_4H_9$— | —O—C$_6$H$_4$—OCH$_3$ | (41) [5] | (11) |
| Y-23 | t-$C_4H_9$— | —O—C$_6$H$_4$—OCH$_3$ | (37) [5] | (3) |
| Y-24 | t-$C_4H_9$— | —$OC_2H_5$ | (37) [5] | (1) |
| Y-25 | t-$C_4H_9$— | —$CH_3$ | (38) [5] | (2) |
| Y-26 | t-$C_4H_9$— | —$C_2H_5$ | (38) [5] | (2) |
| Y-27 | t-$C_4H_9$— | —$CH_3$ | (33) [5] | (2) |
| Y-28 | $CH_3O$—C$_6$H$_4$— | —$OCH_3$ | (42) [5] | (4) |
| Y-29 | $CH_3O$—C$_6$H$_4$— | —N($CH_3$)$_2$ | (40) [5] | (4) |
| Y-30 | C$_6$H$_4$—$OCH_3$ | —$CH_3$ | (43) [5] | (2) |
Y-31
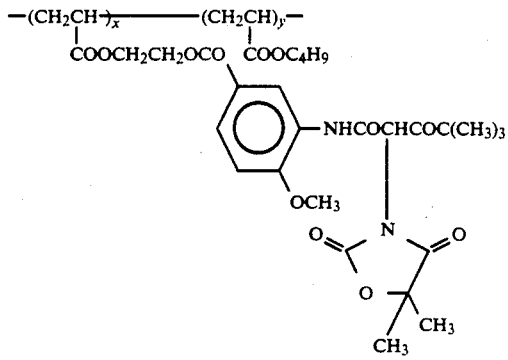
x:y = 55:45 (by weight)

-continued

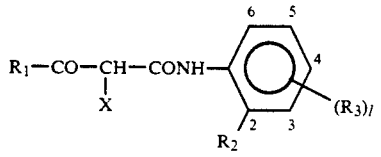

| No. | $R_1$ | $R_2$ | $(R_3)_l$ | X |
|---|---|---|---|---|
| Y-32 | 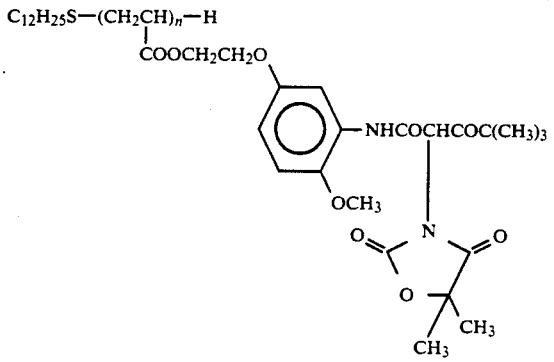 | | | |
| | Average Molecular Weight: 2,000 | | | |
| Y-33 | 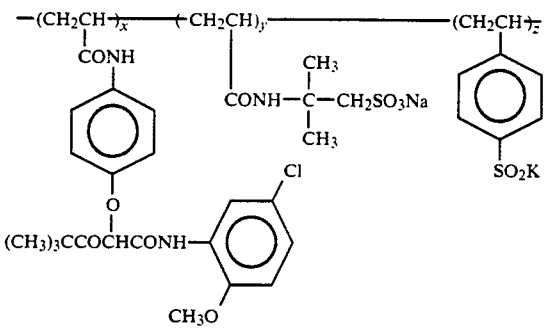 | | | |
| | x:y:z = 40:50:10 (by weight) | | | |
| Y-34 | 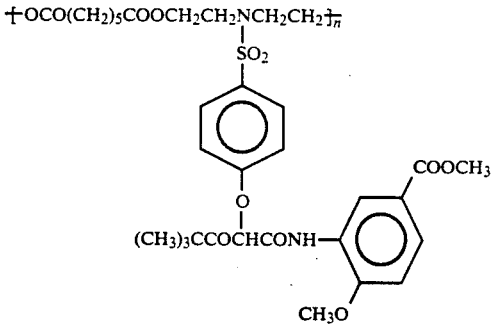 | | | |
| | Average Molecular Weight: 80,000 | | | |

In the above table, a figure in parentheses ( ) denotes the number of specific example of X or R described above, and a figure in brackets [ ] denotes the substitution position on the anilide group.

The yellow dye forming couplers according to the present invention can be employed individually or as a mixture of two or more thereof. Further, they may be employed in a mixture with known yellow dye forming couplers.

The yellow coupler according to the present invention can be employed in any layer of the light-sensitive material, but preferably in a light-sensitive silver halide emulsion layer or a layer adjacent thereto, and more preferably in a light-sensitive silver halide emulsion layer.

The yellow coupler according to the present invention can be synthesized by conventionally known synthesis methods. Specific examples of synthesis methods are described in JP-A-63-123047.

The amount of the yellow coupler according to the present invention used in the light-sensitive material is generally from $1\times10^{-5}$ to $1\times10^{-2}$ mol/m$^2$, preferably from $1\times10^{-4}$ to $5\times10^{-3}$ mol/m$^2$, and more preferably from $2\times10^{-4}$ to $1\times10^{-3}$ mol/m$^2$.

The "surface pH of the layer Of the silver halide color photographic material" according to the present invention as used herein is the pH of all photographic layers obtained by applying coating solutions to a support and can be adjusted by controlling the pH of a coating solution, but the surface pH is not necessarily the same as the pH of the coating solution. This is due to some of the compositions in the coating solution which may change the surface pH depending on drying conditions.

The surface pH of the layer can be determined by the following method as described in JP-A-61-245153. More specifically, (1) on the surface of the silver halide emulsion layer side of the light-sensitive material, 0.05 ml of pure water is dropped, and (2) three minutes after, the surface pH of the layer is measured by a conventional surface pH measuring electrode (e.g., GS-165F manufactured by Toadenpa).

The adjustment of the surface pH of the layer can almost be attained by adjusting the pH of the coating solution as described above and can be conducted using an acid (for example, sulfuric acid, or citric acid) or an alkali (for example, sodium hydroxide, or potassium hydroxide), if desired.

The surface pH of the layer of the photographic material according to the present invention is in a range from about 5.0 to about 6.5, preferably from about 5.5 to about 6.3.

The color photographic light-sensitive material according to the present invention includes a support having coated thereon at least one blue-sensitive silver halide emulsion layer, at least one green-sensitive silver halide emulsion layer and at least one red-sensitive silver halide emulsion layer. In a conventional color printing paper, the light-sensitive layers are usually provided on a support in the order described above, but they can be provided in a different order. Further, an infrared-sensitive silver halide emulsion layer may be employed in place of at least one of the above described emulsion layers. Each of the light-sensitive emulsion layers contains a silver halide emulsion having sensitivity in a respective wavelength region and a color coupler which forms a dye of complementary color to the light to which the silver halide emulsion is sensitive, that is, yellow, magenta and cyan dyes to blue, green and red light, respectively. Thus, color reproduction by a subtractive process can be performed. However, the relationship of the light-sensitive layer and hue of dye formed from the coupler may be varied from that described above, if desired.

The silver halide emulsion used in the present invention is preferably a high silver chloride content emulsion which has a high silver chloride content ratio adapted for rapid processing. The silver chloride content ratio in such a high silver chloride content emulsion is at least 90 mol %, preferably at least 95 mol %.

Of such high silver chloride content emulsions, those having a structure wherein a localized phase of silver bromide is present in the interior and/or on the surface of silver halide grains in a stratified form or in a non-stratified form are preferred. With respect to the halogen composition of the localized phase, it is preferred that the silver bromide content is at least 10 mol %, and more preferably exceeding 20 mol %. The localized phase may exist in the interior of the grain, or at the edge, corner or plane of the surface of the grain. One preferred example is a grain with epitaxial growth at the corner.

For the purpose of minimizing the reduction in sensitivity when pressure is applied to the photographic light-sensitive material, it is also preferred to use uniform structure type grains, wherein the distribution of halogen composition is narrow in a high silver chloride content emulsion having a silver chloride content of at least 90 mol %.

Further, for the purpose of reducing the amount of replenisher for a developing solution, it is effective to further increase the silver chloride content of a silver halide emulsion. In such a case, an almost pure silver chloride may be used wherein the silver chloride content is from 98 mol % to 100 mol %.

The average grain size of silver halide grains in the silver halide emulsion used in the present invention (the grain size being defined as the diameter of a circle having the same area as the projected area of the grain and being averaged by number) is preferably from 0.1 μm to 2 μm.

Moreover, it is preferred to employ a mono-dispersed emulsion which has a grain size distribution such that the coefficient of variation (obtained by dividing the standard deviation of the grain size distribution with the average grain size) is not more than 20%, particularly not more than 15%. Further, it is preferred to employ two or more of the above described monodispersed emulsions in the same layer as a mixture or in the form of superimposed layers for the purpose of obtaining wide latitude.

The silver halide grains contained in the photographic emulsion may have a regular crystal form such as cubic, tetradecahedral or octahedral, or an irregular crystal form such as spherical or tabular, or may have a composite form of these crystal forms. Also, a mixture of grains having various crystal forms may be used. Of these emulsions, those containing grains having the above described regular crystal form in an amount of at least 50%, preferably at least 70%, and more preferably at least 90% are advantageously used in the present invention.

Further, a silver halide emulsion wherein tabular silver halide grains having an average aspect ratio (diameter corresponding to circle/thickness) of at least 5, preferably at least 8, accounts for at least 50% of the total projected area of the silver halide grains may be preferably used in the present invention.

The silver chlorobromide emulsion used in the present invention can be prepared in any suitable manner, for example, by the methods as described in P. Glafkides, *Chemie et Physique Photographique,* (Paul Montel 1967), G.F. Duffin, *Photographic Emulsion Chemistry,* (Focal Press 1966), and V.L. Zelikman et al., *Making and Coating Photographic Emulsion,* (Focal Press 1964). That is, any of an acid process, a neutral process, and an ammonia process can be employed.

Soluble silver salts and soluble halogen salts can be reacted by techniques such as a single jet, process, a double jet process, and a combination thereof. In addition, a reversal mixing process can be used in which silver halide grains are formed in the presence of an excess of silver ions. As one double jet process, a controlled double jet process in which the pAg in a liquid phase where silver halide is formed is maintained at a predetermined level can be employed. This process gives a silver halide emulsion in which the crystal form is regular and the grain size is nearly uniform.

During the step of formation or physical ripening of silver halide grains of the silver halide emulsion used in the present invention, various kinds of multi-valent metal ion impurities can be introduced. Suitable examples of the compounds include cadmium salts, zinc salts, lead salts, copper salts, thallium salts, salts or complex salts of Group VIII elements, for example, iron, ruthenium, rhodium palladium, osmium, iridium, and platinum. Particularly, above-described Group VIII elements are preferably used. The amount of the compound added can be varied over a wide range depending on the purpose, but it is preferably used in a range from $10^{-9}$ to $10^{-2}$ mol per mol of silver halide.

The silver halide emulsions used in the present invention are usually subjected to chemical sensitization and spectral sensitization.

For the chemical sensitization, a sulfur sensitization method (e.g., using an unstable sulfur compound), a noble metal sensitization method, (e.g., using an gold sensitization), and a reduction sensitization method are employed individually or in combination. The compounds preferably used in chemical sensitization include those as described in JP-A-62-215272, page 18, right lower column to page 22, right upper column.

Gold sensitizers are used in the present invention are now described in greater detail.

The gold sensitizer used may be a mono-valent gold compound or a tri-valent gold compound, and various gold compound can be employed. Representative examples of the gold sensitizers include chloroauric acid, potassium chloroaurate, auric trichloride, potassium auricthiocyanate, potassium iodoaurate, tetracyanoauric acid, ammonium aurothiocyanate, pyridyl trichloro gold, and rhodanine gold salt.

The amount of the gold sensitizer to be added is preferably from $1\times10^{-7}$ to $5\times10^{-4}$ mol, more preferably from $5\times10^{-7}$ to $5\times10^{-5}$ mol, per mol of silver halide in the emulsion.

The addition of the gold sensitizer can be conducted at any stage of the production of silver halide emulsion, but preferably is in the period from the completion of the formation of silver halide grains to the completion of chemical sensitization.

Spectral sensitization is performed for the purpose of imparting spectral sensitivity in the desired wavelength range to the emulsion of each layer of the photographic light-sensitive material of the present invention. According to the present invention, the spectral sensitization is conducted by adding a spectral sensitizing dye which is a dye capable of absorbing light of a wavelength range corresponding to the desired spectral sensitivity. Suitable examples of the spectral sensitizing dyes used include those as described, for example, in F.H. Harmer, *Heterocyolic compounds-Cyanine dyes and related compounds,* John Wiley & Sons (New York, London) (1964). Specific examples of the sensitizing dyes preferably employed are described in JP-A-62-215272, page 22, right upper column to page 38.

The silver halide emulsions used in the present invention can contain various compounds or precursors thereof for preventing the occurrence of fog or for stabilizing photographic performance during the production, storage and/or photographic processing of photographic light-sensitive materials. Specific examples of the compounds preferably used are described in JP-A-62-215272, page 39 to page 72.

The silver halide emulsion used in the present invention may be a surface latent image type emulsion wherein latent images are formed mainly on the surface of grains, or an internal latent image type emulsion wherein latent images are formed mainly in the interior of grains.

In the color photographic light-sensitive material according to the present invention, a yellow coupler, a magenta coupler and a cyan coupler which form yellow, magenta and cyan colors respectively upon coupling with the oxidation product of an aromatic primary amine type color developing agent are ordinarily employed.

Cyan couplers and magenta couplers which are preferably used in the present invention include those reprsented by formulae (C-I), (C-II), (M-I), or (M-II):

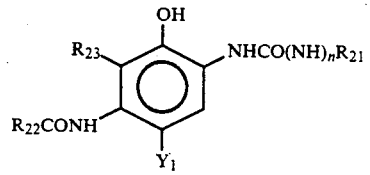

(C-I)

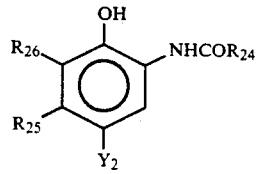

(C-II)

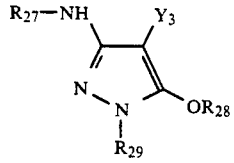

(M-I)

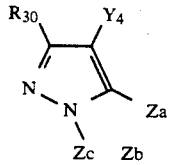

(M-II)

In formulae (C-I) or (C-II), $R_{21}$, $R_{22}$ and $R_{24}$ each represents a substituted or unsubstituted aliphatic, aromatic or heterocyclic group; $R_{23}$, $R_{25}$, and $R_{26}$ each represents hydrogen, a halogen, an aliphatic group, an aromatic group, or an acylamino group or, when these groups are linked, $R_{23}$ and $R_{22}$ represent a non-metallic atomic group necessary for forming a nitrogen-containing 5-membered or 6-membered ring; $Y_1$ and $Y_2$ each represents hydrogen or a group capable of being released upon a coupling reaction with an oxidation product of a color developing agent; and n is 0 or 1.

$R_{25}$ in formula (C-II) preferably represents an aliphatic group, for example, a methyl group, an ethyl group, a propyl group, a butyl group, a pentadecyl group, a tert-butyl group, a cyclohexyl group, a cyclohexylmethyl group, a phenylthiomethyl group, a dodecyloxyphenylthiomethyl group, a butanamidomethyl group, or a methoxymethyl group.

Preferred examples of the cyan couplers represented by formulae (C-I) or (C-II) are described below.

$R_{21}$ in formula (C-I) preferably represents an aryl or a heterocyclic group and more preferably an aryl group substituted with a halogen atom, an alkyl group, an alkoxy group, an aryloxy group, an acylamino group, an acyl group, a carbamoyl group, a sulfonamido group, a sulfamoyl group, a sulfonyl group, a sulfamido group, an oxycarbonyl group, or a cyano group.

When $R_{23}$ and $R_{22}$ in formula (C-I) do not form a ring, $R_{22}$ preferably represents a substituted or unsubstituted alkyl or aryl group and particularly preferably a substituted aryloxy-substituted alkyl group; and $R_{23}$ preferably represents hydrogen.

$R_{24}$ in formula (C-II) preferably represents a substituted or unsubstituted alkyl or aryl group and particularly preferably a substituted aryloxy-substituted alkyl group.

$R_{25}$ in formula (C-II) preferably represents an alkyl group containing from 2 to 15 carbon atoms or a methyl group having a substituent containing one or more carbon atoms. As the substituent, an arylthio group, an alkylthio group, an acylamino group, an aryloxy group, and an alkyloxy group are preferable.

$R_{25}$ in formula (C-II) more preferably represents a substituted or unsubstituted alkyl or aryl group, an alkyl group containing from 2 to 15 carbon atoms and particularly preferably an alkyl group containing from 2 to 4 carbon atoms.

$R_{26}$ in formula (C-II) preferably represents hydrogen or a halogen and particularly preferably chlorine or fluorine.

$Y_1$ and $Y_2$ in formulae (C-I) and (C-II) preferably each represents hydrogen, a halogen, an alkoxy group, an aryloxy group, an acyloxy group, or a sulfonamido group.

In formula (M-I), $R_{27}$ and $R_{29}$ each represents an aryl group; $R_{28}$ represents hydrogen, an aliphatic or aromatic acyl group or an aliphatic or aromatic sulfonyl group; and $Y_3$ represents hydrogen or a coupling-off group.

The aryl group represented by $R_{27}$ or $R_{29}$ is preferably a phenyl group and may be substituted with one or more substituents which are selected from the substituents described for $R_{21}$. When two or more substituents are present, they may be the same or different. $R_{28}$ is preferably hydrogen, an aliphatic acyl group or an aliphatic sulfonyl group, and more preferably a halogen. $Y_3$ is preferably a coupling-off group which is released at any of sulfur, oxygen or nitrogen, and more preferably a coupling-off group of a sulfur atom-releasing type as described, for example, in U.S. Pat. No. 4,351,897 and International Patent Application (Laid Open) No. WO 88/04795.

In formula (M-II), $R_{30}$ represents hydrogen or a substituent; $Y_4$ represents hydrogen or a coupling-off group, and is preferably a halogen or an arylthio group; Za, Zb and Zc, which may be the same or different each represents methine, substituted methine, =N— or —NH—, one of the Za—Zb bond and the Zb—Zc bond being a double bond and the other being a single bond; provided that one of the Zb—Zc bond is a carbon-carbon double bond, the Zb—Zc bond may be a part of a condensed aromatic ring; $R_{30}$ or $Y_4$ may also form a polymer including a dimer or higher oligomer and when Za, Zb or Zc is a substituted methine group, the substituted methine group may form a polymer including a dimer or higher oligomer.

Examples of $R_{30}$ as a substituent include an alkyl group, an aryl group, an alkoxy group, an aryloxy group, an amino group, a carbonamido group, an alkylthio group and an arylthio group.

Of pyrazoloazole type couplers represented by formula (M-II), imidazo[1,2-b]pyrazoles as described in U.S. Pat. No. 4,500,630 are preferred and pyrazolo[1,5-b][1,2,4]triazoles as described in U.S. Pat. No. 4,540,654 are particularly preferred in view of reduced yellow subsidiary adsorption and light fastness of dyes formed therefrom.

Further, pyrazolotriazole couplers having a branched alkyl group directly connected to the 2, 3 or 6 position of the pyrazolotriazole ring as described in JP-A-61-65245, pyrazoloazole couplers having a sulfonamido group as described in JP-A-61-65246, pyrazoloazole couplers having an alkoxyphenylsulfonamido ballast group as described in JP-A-61-147254, and pyrazolotriazole couplers having an alkoxy group or an aryloxy group at the 6 position thereof as described in European Patent (OPI) Nos. 226,849 and 294,785 are also preferably employed.

Specific examples of the couplers represented by formulae (C-I), (C-II), (M-I), or (M-II) are set forth below, but the present invention is not to be construed as being limited thereto.

(C-1)
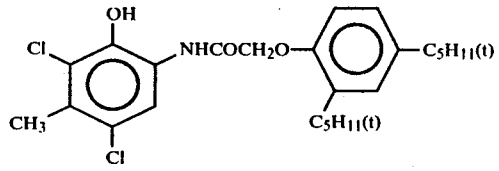
(C-2)
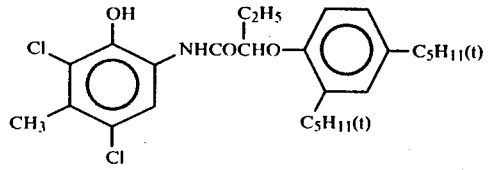
(C-3)
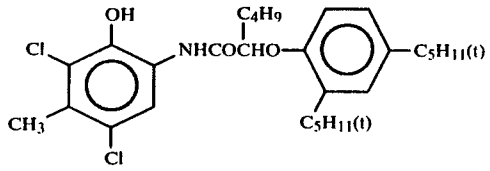
(C-4)
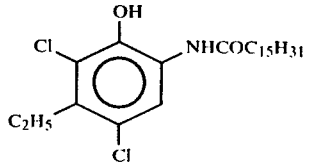
(C-5)
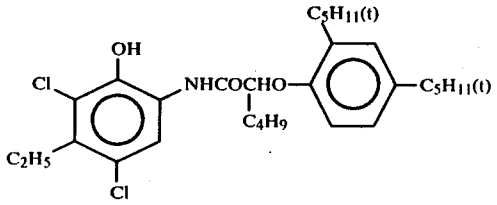
(C-6)
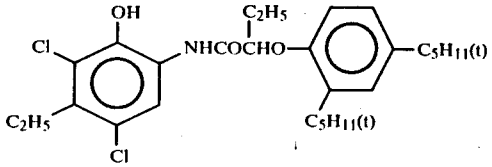
(C-7)
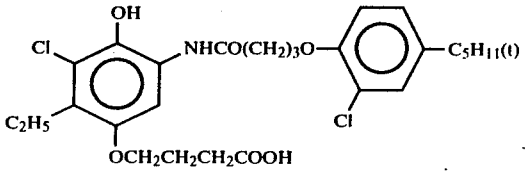
(C-8)
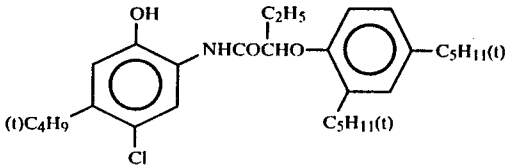
(C-9)
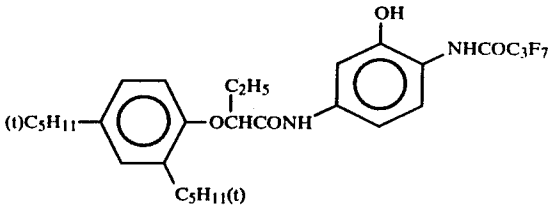
(C-10)
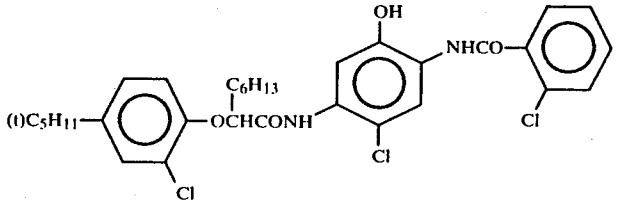

-continued
(C-11)
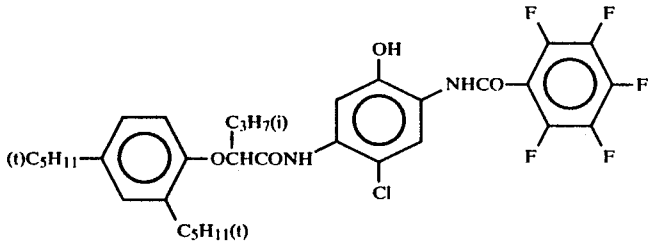
(C-12)
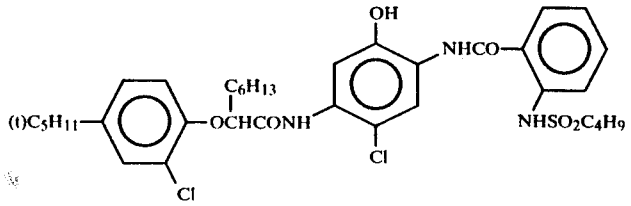
(C-13)
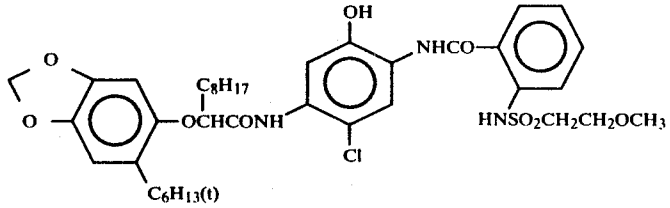
(C-14)
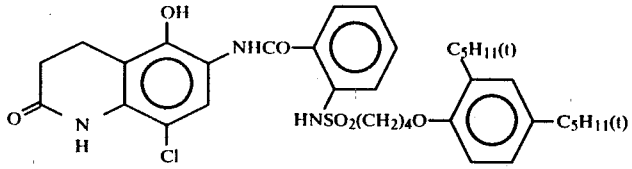
(C-15)
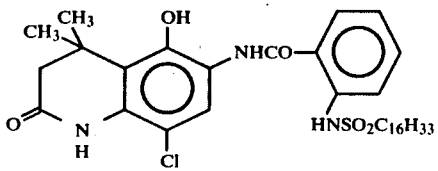
(C-16)
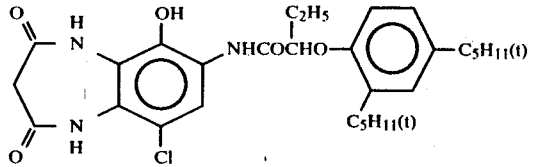
(C-17)
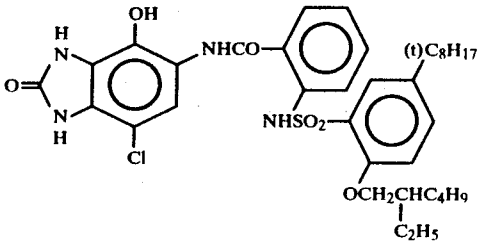
(C-18)
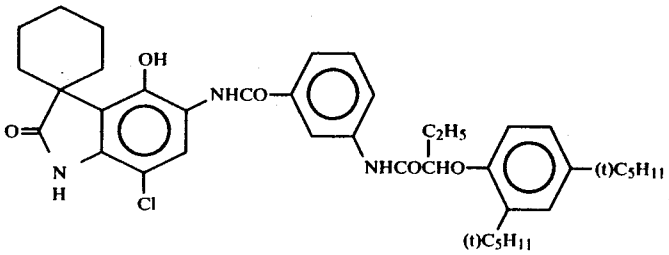

-continued
(C-19)
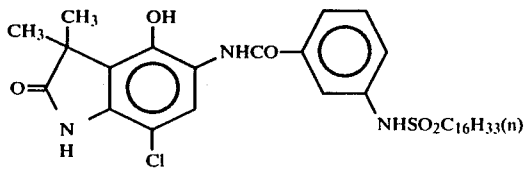
(C-20)
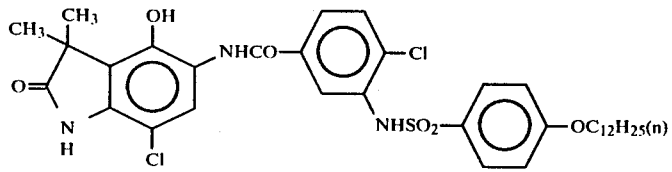
(C-21)
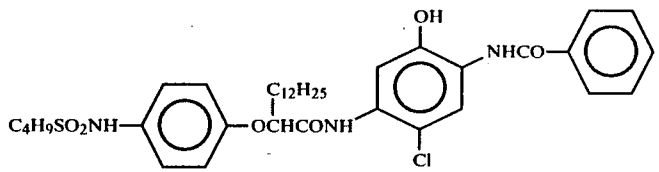
(C-22)
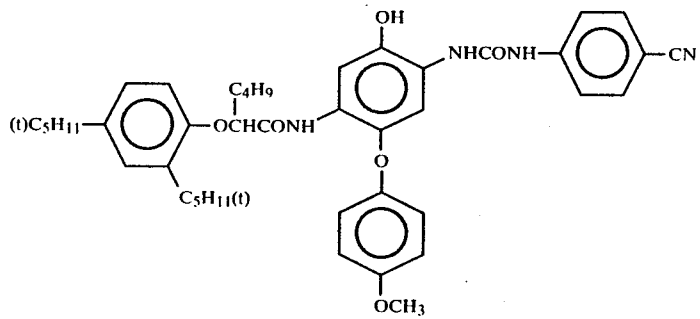
(M-1)
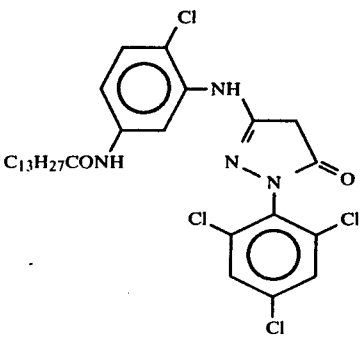
(M-2)
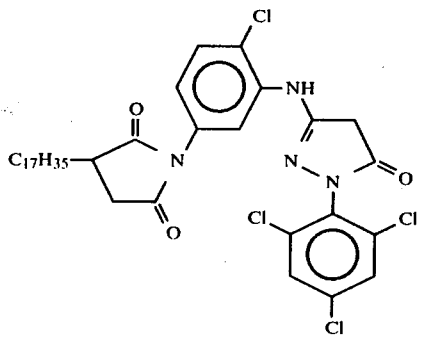

(M-3)
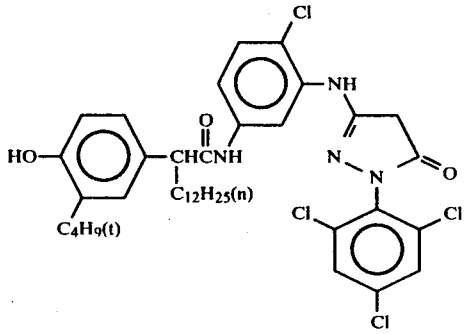
-continued
(M-4)
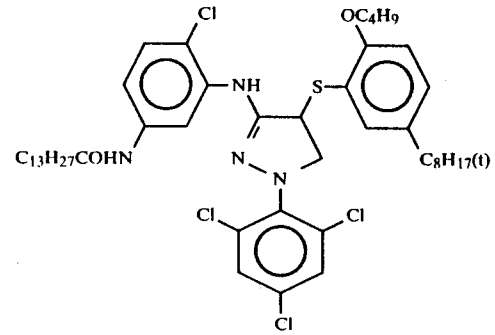
(M-5)
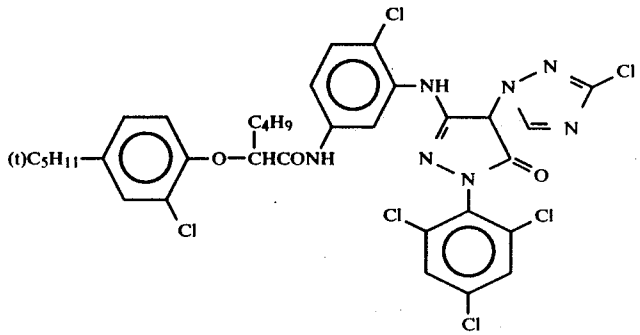
(M-6)
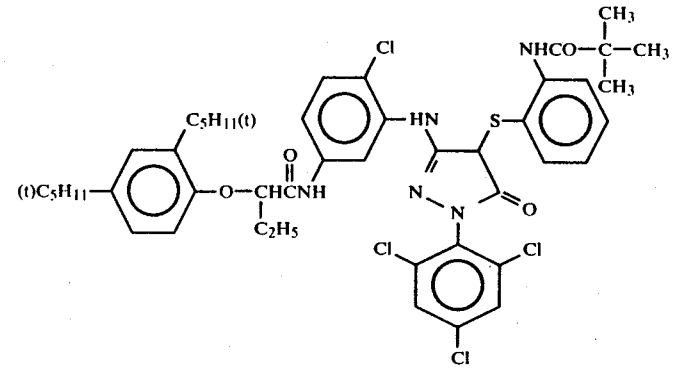
(M-7)
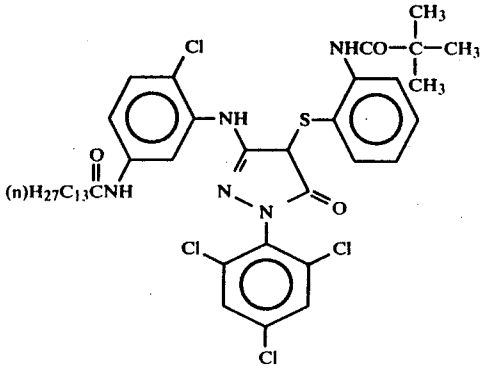
(M-8)
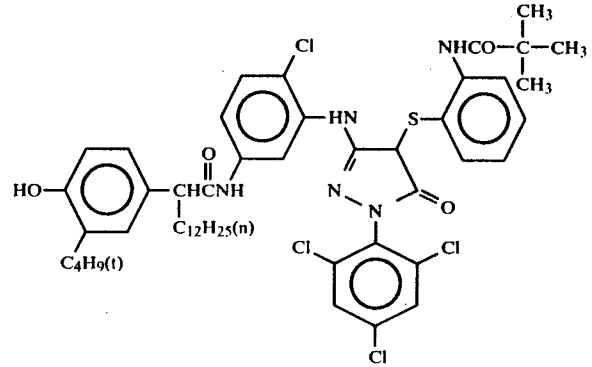

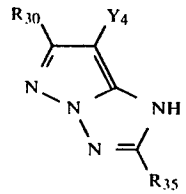
| Compound | $R_{30}$ | $R_{35}$ | $Y_4$ |
|---|---|---|---|
| M-9 | $CH_3$— | 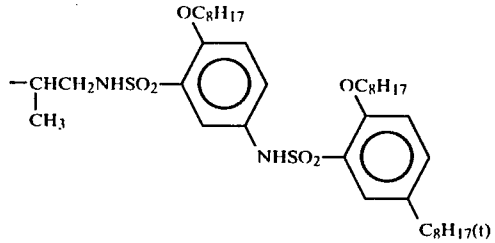 | Cl |
| M-10 | " | 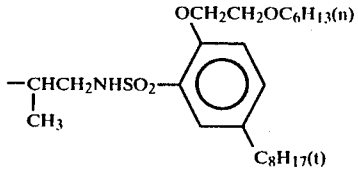 | " |
| M-11 | $(CH_3)_3C$— | 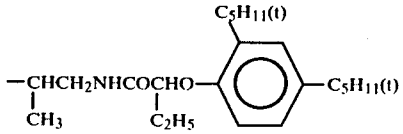 | 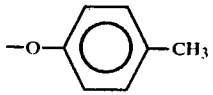 |
| M-12 | 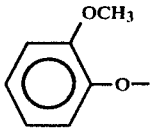 | 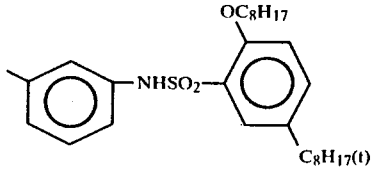 | 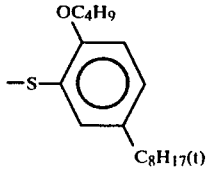 |

-continued
| | | | |
|---|---|---|---|
| M-13 | $CH_3$— | 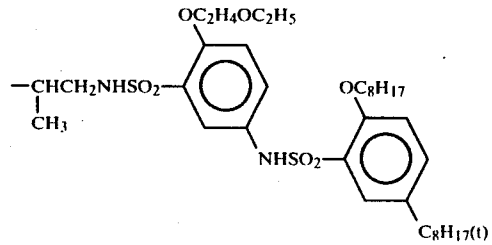 | Cl |
| M-14 | " | 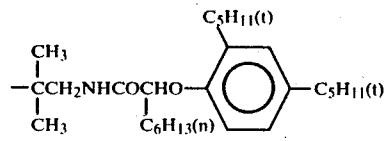 | " |
| M-15 | $CH_3$— | 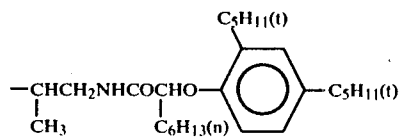 | Cl |
| M-16 | " | 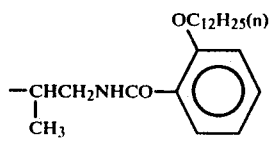 | " |
| M-17 | " | 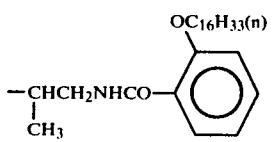 | " |

-continued
| | | | |
|---|---|---|---|
| M-18 | 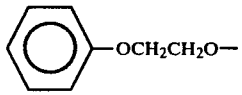 | 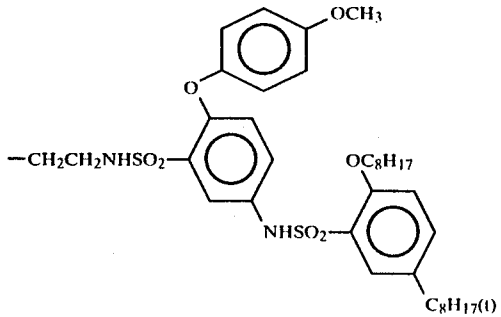 | 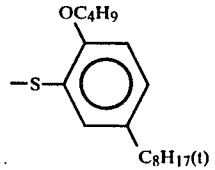 |
| M-19 | $CH_3CH_2O-$ | " | " |
| M-20 | 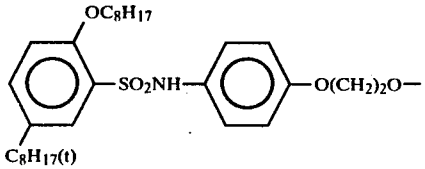 | 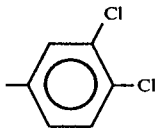 | 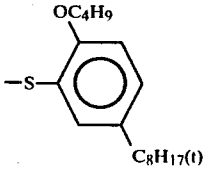 |
| M-21 | 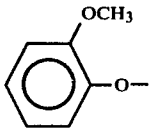 | 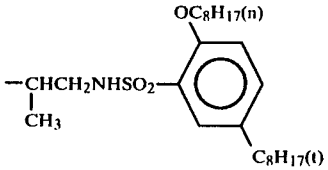 | Cl |
| M-22 | $CH_3-$ | 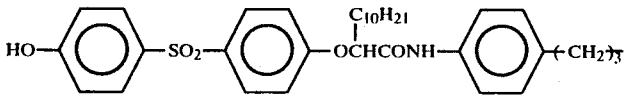 | Cl |
| M-23 | " | 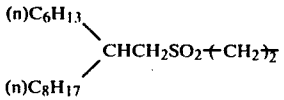 | " |

-continued
| | | | |
|---|---|---|---|
| M-24 | 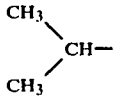 | 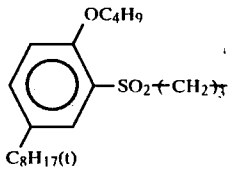 | " |
| M-25 | 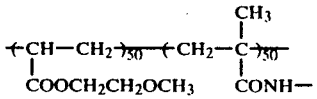 | 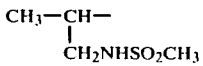 | " |
| M-26 | 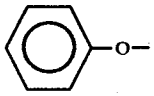 | 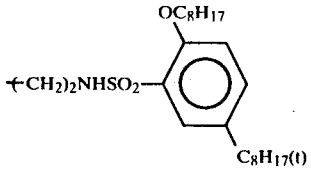 | Cl |
| M-27 | $CH_3$— | 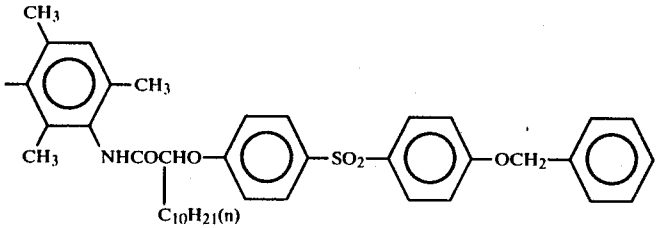 | " |
| M-28 | $(CH_3)_3C$— | 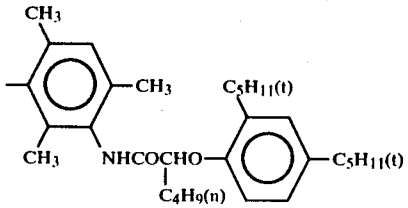 | " |

-continued
| | | | |
|---|---|---|---|
| M-29 | 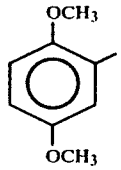 | 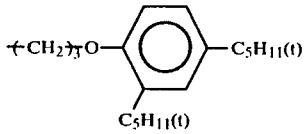 | Cl |
| M-30 | $CH_3-$ | $-CH(C_2H_5)-N(C_{18}H_{37}(n))COCH_2CH_2COOH$ | " |

The coupler represented by formulae (C-I), (C-II), (M-I), or (M-II) described above is incorporated into a silver halide emulsion layer which constitutes a light-sensitive layer in an amount ranging generally from 0.1 to 1.0 mole, preferably from 0.1 to 0.5 mole per mole of silver halide.

In the present invention, the above-described couplers may be added to light-sensitive silver halide emulsion layers by applying various known techniques. Usually, they can be added according to an oil-droplet-in-water dispersion method known as an oil protected process. For example, couplers are first dissolved in a solvent, and then emulsified and dispersed in a gelatin aqueous solution containing a surface active agent. Alternatively, water or a gelatin aqueous solution may be added to a coupler solution containing a surface active agent, followed by phase inversion to obtain an oil-droplet-in-water dispersion. Further, alkali-soluble couplers may also be dispersed using Fischer's dispersion process. The coupler dispersion may be subjected to distillation, noodle washing, ultrafiltration, or the like to remove an organic solvent having a low boiling point and then mixed with a photographic emulsion.

As the dispersion medium of the couplers, it is preferred to employ an organic solvent having a high boiling point which has a dielectric constant of 2 to 20 (at 25° C.) and a refractive index of 1.5 to 1.7 (at 25° C.) and/or a water-insoluble polymer compound.

Preferred examples of the organic solvent having a high boiling point used in the present invention include those represented by the following formulae (A), (B), (C), (D) or (E):

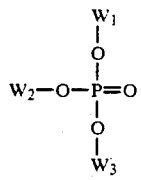
(A)

(B)

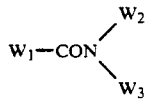
(C)

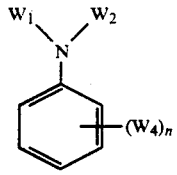
(D)

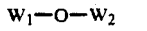
(E)

wherein $W_1$, $W_2$ and $W_3$, which may be the same or different, each represents a substituted or unsubstituted alkyl group, a substituted or unsubstituted cycloalkyl group, a substituted or unsubstituted alkenyl group, a substituted or unsubstituted aryl group or a substituted or unsubstituted heterocyclic group; $W_4$ represents $W_1$, —O—$W_1$ or —S—$W_1$; n is an integer from 1 to 5, and when n is two or more, plural $W_4$ groups may be the same or different; and $W_1$ and $W_2$ in formula (E) may be linked with each other to form a condensed ring.

As the organic solvent having a high boiling point which can be employed in the present invention, any compound which has a melting point of 100° C. or lower and a boiling point of 140° C. or higher and which is immiscible with water and a good solvent for the coupler may be utilized, in addition to the above described solvents represented by formulae (A) to (E). The melting point of the organic solvent having a high boiling point is preferably not more than 80° C. The boiling point of the organic solvent having a high boiling point is preferably 160° C. or higher, more preferably 170° C. or higher.

The organic solvents having a high boiling point are described in detail in JP-A-62-215272, page 137, right lower column to page 144, right upper column.

Further, these couplers can be emulsified and dispersed in an aqueous solution of a hydrophilic colloid by loading them into a loadable latex polymer (such as those described in U.S. Pat. No. 4,203,716), with or without the above-described organic solvent having a high boiling point, or dissolving them in a water-insoluble and organic solvent-soluble polymer.

Suitable examples of the polymers include the homopolymers and copolymers described in International Patent Application (Laid Open) No. WO 88/00723, pages 12 to 30. Particularly, acrylamide polymers are preferably used in view of improved color image stability.

The color photographic light-sensitive material according to the present invention may contain a hydroquinone derivative, an aminophenol derivative, a gallic acid derivative, or an ascorbic acid derivative, as a color fog preventing agent.

In the color photographic light-sensitive material according to the present invention, various color fading preventing agents can be employed. More specifically, representative examples of organic color fading preventing agents for cyan, magenta and/or yellow images include hindered phenols (for example, hydroquinones, 6-hydroxychromans, 5-hydroxychromans, spirochromans, p-alkoxyphenols, or bisphenols), gallic acid derivatives, methylenedioxybenzenes, aminophenols, hindered amines, or ether or ester derivatives thereof derived from each of these compounds by silylation or alkylation of the phenolic hydroxy group thereof. Further, metal complexes such as (bissalicylaldoxymate) nickel complex and (bis-N,N-dialkyldithiocarbamate) nickel complexes may be employed.

Specific examples of the organic color fading preventing agents are described in the following patents or patent applications.

Hydroquinones: U.S. Pat. Nos. 2,360,290, 2,418,613, 2,700,453, 2,701,197, 2,728,659, 2,732,300, 2,735,765, 3,982,944 and 4,430,425, British Patent 1,363,921, U.S. Pat. Nos. 2,710,801 and 2,816,028; 6-hydroxychromanes, 5-hydroxycoumaraus and spirochromanes: U.S. Pat. Nos. 3,432,300, 3,573,050, 3,574,627, 3,698,909 and 3,764,337, JP-A-52-152225; spiroindanes: U.S. Pat. No. 4,360,589; p-alkoxyphenols: U.S. Pat. No. 2,735,765, British Patent 2,066,975, JP-A-59-10539, JP-B-57-19765, etc.; hindered phenols: U.S. Patent 3,700,455, JP-A-52-72224, U.S. Pat. No. 4,228,235, JP-B-52-6623; gallic acid derivatives, methylenedioxybenzenes and aminophenols: U.S. Pat. Nos. 3,457,079 and 4,332,886, JP-B-56-21144; hindered amines: U.S. Pat. Nos. 3,336,135 and 4,268,593, British Patents 1,326,889, 1,354,313 and 1,410,846, JP-B-51-1420, JP-A-58-114036, JP-A-59-53846, and JP-A-59-78344.

Further, specific examples of the metal complexes are described in U.S. Pat. Nos. 4,050,938 and 4,241,155, and British Patent 2,027,731.

The color fading preventing agent is co-emulsified with the corresponding color coupler in an amount of from 5 to 100% by weight of the color coupler and incorporated into the light-sensitive layer.

In order to prevent degradation of the cyan dye image due to heat and particularly due to light, it is effective to introduce an ultraviolet light absorbing agent into a cyan color forming layer or both layers adjacent to the cyan color forming layer.

Suitable examples of the ultraviolet light absorbing agents used include aryl group-substituted benzotriazole compounds (for example, those described in U.S. Pat. No. 3,533,794), 4-thiazolidone compounds (for example, those described in U.S. Pat. Nos. 3,314,794 and 3,352,681), benzophenone compounds (for example, those described in JP-A-46-2784), cinnamic acid ester compounds (for example, those described in U.S. Pat. Nos. 3,705,805 and 3,707,395), butadiene compounds (for example, those described in U.S. Pat. No. 4,045,229), and benzoxazole compounds (for example, those described in U.S. Pat. Nos. 3,406,070, 3,677,672 and 4,271,307). Furthermore, ultraviolet light absorptive couplers (for example, α-naphtholic cyan dye forming couplers) or ultraviolet light absorptive polymers may be used as ultraviolet light absorbing agents. These ultraviolet light absorbing agents may be mordanted in a specific layer.

Among these ultraviolet light absorbing agents, the aryl group-substituted benzotriazole compounds described above are preferred.

In accordance with the present invention, it is preferred to employ the following compounds together with the above described couplers, particularly pyrazoloazole couplers. More specifically, it is preferred to employ individually, or in combination, a compound (F) which is capable of forming a chemical bond with the aromatic amine developing agent remaining after color development to give a chemically inactive and substantially colorless compound and/or a compound (G) which is capable of forming a chemical bond with the oxidation product of the aromatic amine developing agent remaining after color development to give a chemically inactive and substantially colorless compound. These compounds prevent the occurrence of stain and other undesirable side-effects due to the formation of colored dye upon a reaction of the color developing agent or oxidation product thereof which remains in the photographic layer with the coupler during preservation of the photographic material after processing.

Among the compounds (F), those capable of reacting at a second order reaction rate constant $k_2$ (in trioctyl phosphate at 80° C.) with p-anisidine of from 1.0 liter/mol·sec. to $1\times10^{-5}$ liter/mol·sec. are preferred. The second order reaction rate constant can be measured by a method described in JP-A-63-158545.

When the constant $k_2$ is larger than this range, the compounds are unstable and may react with gelatin or water to decompose. On the other hand, when the constant k2 is smaller than the above described range, the reaction rate in the reaction with the remaining aromatic amine developing agent is low, and as a result, the reaction with the remaining aromatic amine developing agent, which is the object of the use, tends to be reduced.

Preferred compounds (F) are represented by formulae (FI) or (FII):

$$R_{31}-(A)_n-X \qquad \text{(FI)}$$

$$R_{32}-\underset{\underset{B}{|}}{C}=Y_5 \qquad \text{(FII)}$$

wherein $R_{31}$ and $R_{32}$ each represents an aliphatic group, an aromatic group or a heterocyclic group; n is 0 or 1; A represents a group capable of reacting with an aromatic amine developing agent to form a chemical bond; X represents a group capable of being released upon the reaction with an aromatic amine developing agent; B represents hydrogen, an aliphatic group, an aromatic group, a heterocyclic group, an acyl group or a sulfonyl group; $Y_5$ represents a group capable of accelerating the addition of an aromatic amine developing agent to the compound represented by formula (FII); and $R_{31}$ and X, or $Y_5$ and $R_{32}$ or B may be linked to form a cyclic structure.

Of the reactions for forming a chemical bond with the remaining aromatic amine developing agent, a substitution reaction and an addition reaction are typical reactions.

Specific preferred examples of the compounds represented by formulae (FI) or (FII) are described, for example, in JP-A-63-158545, JP-A-62-283338, European Patent (OPI) Nos. 298,321 and 277,589.

Preferred compounds (G) capable of forming a chemical bond with the oxidation product of the aromatic amine developing agent remaining after color development processing to give a chemically inactive and substantially colorless compound, are represented by formula (GI):

$$R_{33}-Z \qquad \text{(GI)}$$

wherein $R_{33}$ represents an aliphatic group, an aromatic group or a heterocyclic group; and Z represents a nucleophilic group or a group capable of being decomposed in the photographic material to release a nucleophilic group.

Of the compounds represented by formula (GI), those wherein Z is a group having a Pearson's nucleophilic $^{n}CH_3I$ value of at least 5 (R.G. Pearson et al., *J. Am. Chem. Soc.*, Vol. 90, page 319 (1968)) or a group derived therefrom are preferred.

Specific preferred examples of the compounds represented by formula (GI) are described, for example, in European Patent (OPI) No. 255,722, JP-A-62-143048, JP-A-62-229145, JP-A-1-230039 and Japanese Patent Application No. 62-214681, European Patent (OPI) Nos. 298,321 and 277,589.

Further, combinations of Compound (G) and Compound (F) are described in detail in European Patent (OPI) No. 277,589.

The photographic light-sensitive material according to the present invention may contain water-soluble dyes or dyes which become water-soluble at the time of photographic processing as filter dyes or for irradiation or halation prevention or other various purposes in the hydrophilic colloid layers. Examples of such dyes include oxonol dyes, hemioxonol dyes, styryl dyes, merocyanine dyes, cyanine dyes, and azo dyes. Of these dyes, oxonol dyes, hemioxonol dyes, and merocyanine dyes are useful.

As binders or protective colloids which can be used for the emulsion layers of the color photographic light-sensitive material according to the present invention, gelatin is advantageously used, but other hydrophilic colloids can be used alone or together with gelatin.

As gelatin, lime-treated gelatin or acid-treated gelatin can be used in the present invention. Details of the production of gelatin are described in Arther Weiss, *The Macromolecular Chemistry of Gelatin,* (Academic Press, 1964).

The support used in the present invention, includes those conventionally employed in photographic light-sensitive materials, for example, transparent films such as cellulose nitrate films and polyethylene terephthalate films, or reflective supports. For the purpose of the present invention, reflective supports are preferred.

The term "reflective support" used herein means a support having an increased reflection property for the purpose of rendering dye images formed in the silver halide emulsion layer clear. Examples of the reflective support include a support having coated thereon a hydrophobic resin containing a light reflective substance such as titanium oxide, zinc oxide, calcium carbonate, or calcium sulfate dispersed therein and a support composed of a hydrophobic resin containing a light reflective substance dispersed therein. More specifically, they include baryta coated paper; polyethylene coated paper; polypropylene type synthetic paper; transparent supports, for example, a glass plate, a polyester film such as a polyethylene terephthalate film, a cellulose triacetate film or a cellulose nitrate film, a polyamide film, a polycarbonate film, a polystyrene film, or a vinyl chloride resin, having a reflective layer or having incorporated therein a reflective substance.

Other examples of the reflective support which can be used are supports having a metal surface of mirror reflectivity or secondary diffuse reflectivity. The metal surface preferably has a spectral reflectance of 0.5 or more in the visible wavelength range. The metal surface is preferably produced by roughening or imparting diffusion reflectivity using metal powders. Suitable examples of metals include aluminum, tin, silver, magnesium or an alloy thereof. The metal surface includes a metal plate, a metal foil or a metal thin layer obtained by rolling, vacuum deposition or plating. Among them, a metal surface obtained by vacuum deposition of metal on other substrate is preferably employed.

On the metal surface it is preferred to provide a water-proof resin layer, particularly a thermoplastic resin layer. On the opposite side of the support to the metal surface according to the present invention, an antistatic layer is preferably provided. Details of these supports are described, for example, in JP-A-61-210346, JP-A-63-24247, JP-A-63-24251 and JP-A-63-24255.

A suitable support can be appropriately selected depending on the purpose of use.

As the light reflective substance, white pigments thoroughly kneaded in the presence of a surface active agent are employed, and pigments having a surface treated with a dihydric, trihydric or tetrahydric alcohol are preferably used.

The occupied area ratio (%) per unit area of fine white pigment particles can be determined in the following manner. Specifically, the areas observed is divided into unit areas of 6 $\mu m \times 6$ $\mu m$ adjacent to each other, and the occupied area ratio (Ri) (%) of the fine particles projected on the unit area is measured. The coefficient of variation of the occupied area ratio (%) is a ratio of $S/\overline{R}$ wherein S is the standard deviation of Ri and $\overline{R}$ is an average value of Ri. The number (n) of the unit area subjects is preferably 6 or more. Thus, the coefficient of variation ($S/\overline{R}$) is obtained by the following equation:

$$\sqrt{\frac{\sum_{i=1}^{n}(Ri-R)^2}{n-1}} \Big/ \frac{\sum_{i=1}^{n} Ri}{n}$$

In the present invention, the coefficient of variation of the occupied area ratio (%) of fine pigment particles is preferably not more than 0.15, particularly preferably not more than 0.12. When the value is not more than 0.08, the dispersibility of particles can be designated as substantially uniform.

The color photographic light-sensitive material according to the present invention is preferably subjected to color development, bleach-fixing and water washing processing or stabilizing processing. Bleaching and fixing can be performed separately or by the above-described mono-bath processing.

The color developing solution used in the present invention contains a known aromatic primary amine color developing agent. Preferred examples thereof are p-phenylenediamine derivatives. Typical examples of the p-phenylenediamine derivative used are set forth below, but the present invention is not to be construed as being limited thereto.

D-1: N,N-Diethyl-p-phenylenediamine
D-2: 2-Amino-5-diethylaminotoluene
D-3: 2-Amino-5-(N-ethyl-N-laurylamino)toluene
D-4: 4-[N-Ethyl-N-(β-hydroxyethyl)amino]aniline
D-5 2-Methyl-4-[N-ethyl-N-(8-hydroxyethyl)amino]-aniline
D-6: 4-Amino-3-methyl-N-ethyl-N-[β-(methanesulfonamido)ethyl]aniline
D-7: N-(2-Amino-5-diethylaminophenylethyl) methanesulfonamide
D-8: N,N-Dimethyl-p-phenylenediamine
D-9: 4-Amino-3-methyl-N-ethyl-N-methoxyethylaniline
D-10: 4-Amino-3-methyl-N-ethyl-N-β-ethoxyethylaniline
D-11: 4-Amino-3-methyl-N-ethyl-N-β-butoxyethylaniline Of these p-phenylenediamine derivatives, 4-amino-3-methyl-N-ethyl-N-[β-(methanesulfonamido)ethyl]aniline (D-6) is particularly preferred.

These p-phenylenediamine derivatives may be in the form of salts such as sulfates, hydrochlorides, sulfites, or p-toluenesulfonates.

The aromatic primary amine developing agent is used in an amount of from about 0.1 g to about 20 g and preferably from about 0.5 g to about 10 g per liter of the developing solution.

According to the present invention, it is preferred to use a color developing solution substantially without benzyl alcohol. The terminology "color developing solution substantially without benzyl alcohol" as used herein means that the color developing solution contains preferably not more than 2 ml, more preferably not more than 0.5 ml, and most preferably no benzyl alcohol per liter of the solution.

The color developing solution used in the present invention more preferably is substantially free from sulfite ion content. While the sulfite ion acts as a preservative for the color developing agent, it has a silver halide solubilizing function and also reacts with the oxidation product of the color developing agent to decrease dye forming efficiency. These functions are one of the reasons which cause fluctuations of photographic performance due to a continuous processing. The terminology "color developing solution substantially free from sulfite ion content" as used herein means that the color developing solution preferably has a sulfite ion concentration of not more than $3.0\times10^{-3}$ mol per liter of the solution. It is most preferred that the color developing solution does not contain sulfite ion at all, with the exception of a very small amount of sulfite ion which is used as an antioxidant in a processing agent kit containing the concentrated color developing agent for the preparation of processing solution.

The color developing solution used in the present invention preferably is substantially without hydroxylamine. This is because hydroxylamine has both a function as a preservative for the developing solution and an activity of developing silver, and it is believed that the fluctuation of concentration of hydroxylamine greatly influences the photographic performance. The terminology "color developing solution substantially without hydroxylamine" as used herein means that the color developing solution preferably has a hydroxylamine concentration of not more than $5.0\times10^{-3}$ mol per liter of solution. It is most preferred that the color developing solution does not contain hydroxylamine at all.

The color developing solution used in the present invention more preferably contains an organic preservative in place of the above described hydroxylamine and sulfite ion. The term "organic preservative" as used herein means any organic compound which can reduce the degradation rate of the aromatic primary amine color developing agent when it is added to a processing solution for the color photographic materials. More specifically, it includes organic compounds which have a function of preventing the oxidation of color developing agent by the air or the like. Among them, hydroxylamine derivatives (excepting hydroxylamine), hydroxamic acids, hydrazines, hydrazides, phenols, α-hydroxyketones, α-aminoketones, saccharides, monoamines, diamines, polyamines, quaternary ammonium salts, nitroxy radicals, alcohols, oximes, diamide compounds, and condensed ring amines are particularly effective organic preservatives. Specific examples thereof are described, for example, in JP-A-63-4235, JP-A-63-30845, JP-A-63-21647, JP-A-63-44655, JP-A-63-53551, JP-A-63-43140, JP-A-63-56654, JP-A-63-58346, JP-A-63-43138, JP-A-63-146041, JP-A-63-44657, JP-A-63-44656, U.S. Pat. Nos. 3,651,503 and 2,494,903, JP-A-52-143020, and JP-B-48-30496.

Other preservatives such as various metals as described in JP-A-57-44148 and JP-A-57-53749, salicylic acids as described in JP-A-59-180588, alkanolamines as described in JP-A-54-3532, polyethyleneimines as described in JP-A-56-94349, or aromatic polyhydroxy compounds as described in U.S. Pat. No. 3,746,544, may be incorporated into the color developing solution, if desired. Particularly, the addition of alkanol amines such as triethanolamine, dialkylhydroxylamines such as diethylhydroxylamine, hydrazine derivatives or aromatic polyhydroxy compounds is preferred.

Of the above described organic preservatives, hydroxylamine derivatives and hydrazine derivatives (hydrazines and hydrazides) are particularly preferred and described in detail, for example, in JP-A-1-97953, JP-A-1-186939, JP-A-1-186940 and JP-A-1-187557.

Further, it is more preferred that the above described hydroxylamine derivative or hydrazine derivative is used in combination with an amine in view of improvement in stability of the color developing solution, and as a result, improvement in stability during continuous processing. The above described amines include cyclic amines as described in JP-A-63-239444, amines as described in JP-A-63-128340, and amines as described in JP-A-1-186939 and JP-A-1-187557.

In the present invention, the color developing solution preferably contains a chloride ion in a range of from $3.5\times10^{-2}$ to $1.5\times10^{-1}$ mol per liter, particularly from $4\times10^{-2}$ to $1\times10^{-1}$ mol per liter of the solution. When the chloride ion concentration is more than $1.5\times10^{-1}$ mol per liter, development tends to be retarded, and it is not preferred to achieve the object of the present invention wherein the high maximum density is provided by a rapid processing. A chloride ion concentration of less than $3.5\times10^{-2}$ mol per liter is not preferred in view of prevention of fog formation.

Also, the color developing solution used in the present invention preferably contains bromide ion in a range of from $3.0\times10^{-5}$ to $1.0\times10^{-3}$ mol per liter, more preferably from $5.0\times10^{-5}$ to $5\times10^{-4}$ mol per liter of the solution. When the bromide ion concentration is more than $1\times10^{-3}$ mol per liter, development tends to be retarded and the maximum density and sensitivity may decrease. When it is less than $3.0\times10^{-5}$ mol per liter, it is difficult to sufficiently prevent fog formation.

The chloride ions and bromide ions can be directly added to the color developing agent or may be released from the light-sensitive material during development processing.

When directly adding the chloride ions and bromide ions to the color developing solution, suitable examples of compounds which supply chloride ion include sodium chloride, potassium chloride, ammonium chloride, lithium chloride, nickel chloride, magnesium chloride, manganese chloride, calcium chloride, and cadmium chloride. Among them, sodium chloride and potassium chloride are preferred. Also, it may be supplied from a fluorescent brightening agent added to the color developing solution.

Suitable examples of compounds which supply a bromide ion include sodium bromide, potassium bromide, ammonium bromide, lithium bromide, calcium bromide, magnesium bromide, manganese bromide, nickel bromide, cadmium bromide, cerium bromide, and thallium bromide. Among them, potassium bromide and sodium bromide are preferred.

When the chloride ion and bromide ion are supplied from the light-sensitive material during development processing, they may be supplied from silver halide emulsions or from other additives in the light-sensitive material.

The color developing solution used in the present invention has a pH which ranges preferably from 9 to 12 and more preferably from 9 to 11.0. The color developing solution may also contain any of the compounds that are known to be usable as components of developing solutions.

In order to maintain the pH in the above-described range, various kinds of buffers are preferably employed. Suitable examples of these buffers include carbonates, phosphates, borates, tetraborates, hydroxybenzoates, glycine salts, N,N,-dimethylglycine salts, leucine salts, norleucine salts, guanine salts, 3,4-dihydroxyphenylalanine salts, alanine salts, aminobutyrate, 2-amino-2-methyl-1,3-prepanediol salts, valine salts, proline salts, trishydroxyaminomethane salts, and lysine salts.

Particularly, carbonates, phosphates, tetraborates, and hydroxybenzoates are preferably employed since they are excellent in solubility and in buffering function at a high pH range greater than 9.0, and they do not adversely affect on photographic performance (for example, fog formation) when they are added to the color developing solution, and they are available at low cost.

Specific examples of these buffers include sodium carbonate, potassium carbonate, sodium bicarbonate, potassium bicarbonate, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate), and potassium 5-sulfo-2-hydroxybenzoate (potassium 5-sulfosalicylate). The present invention, however, is not to be construed as being limited to these compounds.

The amount of the buffer to be added to the color developing solution is preferably 0.1 mol or more and more preferably from 0.1 mol to 0.4 mol per liter thereof.

In addition, various chelating agents can be used in the color developing solution according to the present invention for the purpose of preventing calcium or magnesium precipitation or increasing the stability of the color developing solution.

Specific examples of the chelating agents used are set forth below, but the present invention is not to be construed as being limited thereto.

Nitrilotriacetic acid
Diethylenetriaminepentaacetic acid
Ethylenediaminetetraacetic acid
N,N,N-Trimethylenephosphonic acid
Ethylenediamine-N,N,N',N'-tetramethylenesulfonic acid
Trans-cyclohexanediaminetetraacetic acid
1,2-Diaminopropanetetraacetic acid
Glycol ether diaminetetraacetic acid
Ethylenediamine-o-hydroxyphenylacetic acid
2-Phosphobutane-1,2,4-tricarboxylic acid
1-Hydroxyethylidene-1,1-diphosphonic acid
N,N'-Bis(2-hydroxybenzyl)ethylenediamine-N,N'-diacetic acid Two or more kinds of such chelating agents may be employed together, if desired.

The chelating agent is added to the color developing solution in an amount sufficient to block metal ions present therein. For example, a range of from about 0.1 g to about 10 g per liter of the color developing solution is employed.

The color developing solution may contain appropriate development accelerators, if desired. Examples of suitable development accelerators include thioether type compounds as described in JP-B-37-16088, JP-B-37-5987, JP-B-38-7826, JP B-44-12380, JP-B-45-9019 and U.S. Pat. No. 3,813,247; p-phenylenediamine type compounds as described in JP-A-52-49829 and JP-A-50-15554; quaternary ammonium salts as described in JP-A-50-137726, JP-B-44-30074, JP-A-56-156826 and JP-A-52-43429; amine type compounds as described in U.S. Pat. Nos. 2,494,903, 3,128,182, 4,230,796, 3,253,919, 2,482,546, 2,596,926, and 3,582,346 and JP-B-41-11431; polyalkylene oxides as described in JP-B-37-16088, JP-B-42-25201, U.S. Pat. No. 3,128,183, JP-B-41-11431, JP-B-42-23883 and U.S. Pat. Nos. 3,532,501; 1-phenyl-3-pyrazolidones; and imidazoles.

The color developing solution used in the present invention may contain appropriate antifoggants, if desired. Alkali metal halides such as sodium chloride, potassium bromide, and potassium iodide as well as organic antifoggants may be employed as antifoggants. Representative examples of organic antifoggants include nitrogen-containing heterocyclic compounds such as benzotriazole, 6-nitrobenzimidazole, 5-nitroisoindazole, 5-methylbenzotriazole, 5-nitrobenzotriazole, 5-chlorobenzotriazole, 2-thiazolylbenzimidazole, 2-thiazolylmethylbenzimidazole, indazole, hydroxyazaindolizine and adenine.

It is preferred that the color developing solution according to the present invention contains fluorescent brightening agents. As fluorescent brightening agents, 4,4'-diamino-2,2'-disulfostilbene type compounds are preferred. The amount of the fluorescent brightening agent added is from 0 to 5 g and preferably from 0.1 g to 4 g per liter of the color developing solution.

Furthermore, the color developing solution according to the present invention may contain various surface active agents such as alkylsulfonic acids, arylsulfonic acids, aliphatic carboxylic acids, and aromatic carboxylic acids, if desired.

The processing temperature of the color development step used in the present invention is usually from 20° C. to 50° C. and preferably from 30° C. to 40° C. The processing time is usually from 20 sec. to 5 min. and preferably from 30 sec. to 2 min. Further, the amount of a replenisher for the color developing solution is preferably as small as possible, and is usually from 20 ml to 600 ml, preferably from 50 ml to 300 ml, more preferably from 60 ml to 200 ml, and most preferably from 60 ml to 150 ml per square meter of the color photographic light-sensitive material.

A silver removing step used in the present invention is described in detail below.

The silver removing step used in the present invention can be conducted using any general steps including a bleaching step-fixing step, fixing step-bleach-fixing step, bleaching step-bleach-fixing step, and bleach-fixing step.

Now, bleaching solutions, bleach-fixing solutions and fixing solutions which can be employed in the present invention are described below.

Bleaching agents used in the bleaching solutions or the bleach-fixing solutions according to the present invention include any conventional bleaching agents. Particularly, organic complex salts of iron (III), for example, complex salts of aminopolycarboxylic acids (e.g., ethylenediaminetetraacetic acid, or diethylenetriaminepentaacetic acid), aminopolyphosphonic acids, phosphonocarboxylic acids and organic phosphonic acids, or complex salts of organic acids (e.g., citric acid, tartaric acid, or malic acid), persulfates and hydrogen peroxide are preferably used. Of these compounds, organic complex salts of iron (III) are particularly preferred in view of a rapid processing and prevention of environmental pollution.

Specific examples of useful aminopolycarboxylic acids, aminopolyphosphonic acids and organic phosphonic acids suitable for forming organic complex salts of iron (III) are set forth below.

Ethylenediaminetetraacetic acid

Diethylenetriaminepentaacetic acid
1,3-Diaminopropanetetraacetic acid
Propylenediaminetetraacetic acid
Nitrilotriacetic acid
Cyclohexanediaminetetraacetic acid
Methyliminodiacetic acid
Iminodiacetic acid
Glycol ether diaminetetraacetic acid These compounds may be in the form of salt such as sodium, potassium, lithium or ammonium.

Of these compounds, iron (III) complex salt of ethylenediaminetetraacetic acid, diethylenetriaminepentaacetic acid, cyclohexanediaminetetraacetic acid, 1,3-diaminopropanetetraacetic acid or methyliminodiacetic acid are preferred because of their high bleaching ability.

The ferric ion complex salts may be used in the form of a complex salt per se or may be formed in situ in solution by using a ferric salt (e.g., ferric sulfate, ferric chloride, ferric nitrate, ferric ammonium sulfate or ferric phosphate) and a chelating agent (e.g., an aminopolycarboxylic acid, an aminopolyphosphonic acid or a phosphonocarboxylic acid). Further, a chelating agent may be used in an excess amount of that necessary for forming a ferric ion complex salt.

Of the ferric complex salts, aminopolycarboxylic acid ferric complex salts are preferred.

The amount of the ferric iron complex salt in the solution is from 0.01 mol to 1.0 mol, preferably from 0.05 mol to 0.50 mol per liter of the solution.

In the bleaching solution, bleach-fixing solution, and/or a prebath thereof as bleach accelerating agents, various kinds of compounds can be used. Specific examples of suitable bleach accelerating agents include compounds having a mercapto group or a disulfide bond as described, for example, in U.S. Pat. No. 3,893,858, West German Patent 1,290,812, JP-A-53-95630, *Research Disclosure,* No. 17129 (July, 1978); thiourea type compounds as described, for example, in JP-B-45-8506, JP-A-52-20832, JP-A-53-32735 and U.S. Pat. No. 3,706,561; and halides such as iodine ions, or bromine ions. These compounds are preferred in view of their large bleaching ability.

The bleaching solution or bleach-fixing solution used in the present invention can contain rehalogenating agents such as bromides (e.g., potassium bromide, sodium bromide, ammonium bromide), chlorides (e.g., potassium chloride, sodium chloride, or ammonium chloride) or iodides (e.g., ammonium iodide). Further, one or more kinds of inorganic acids, organic acids, alkali metal salts thereof or ammonium salts thereof which have a pH buffering ability (e.g., borax, sodium metaborate, acetic acid, sodium acetate, sodium carbonate, potassium carbonate, phosphorous acid, phosphoric acid, sodium phosphate, citric acid, sodium citrate, or tartaric acid), corrosion preventing agents (e.g., ammonium nitrate, or guanidine) may be added, if desired.

As fixing agents which can be employed in the bleaching solution or bleach-fixing solution according to the present invention, known fixing agents such as thiosulfates (e.g., sodium thiosulfate, or ammonium thiosulfate), thiocyanates (e.g., sodium thiocyanate, or ammonium thiocyanate), thioether compounds (e.g., such as ethylenebisthioglycolic acid, or 3,6-dithia-1,8-octanediol), and water-soluble silver halide dissolving agents (e.g., thioureas) are exemplified. They are employed individually or in a combination of two or more thereof. In addition, a special bleach-fixing solution comprising a combination of fixing agent and a large amount of a halide compound such as potassium iodide as described in JP-A-55-155354 can be used as well. In the present invention, a thiosulfate, particularly ammonium thiosulfate, is preferably employed.

The amount of fixing agent to be used in the solution is preferably from 0.3 mol to 2 mol, and more preferably from 0.5 mol to 1.0 mol per liter of the solution.

The pH of the bleach-fixing solution or fixing solution used in the present invention is preferably from 3 to 10, and more preferably from 5 to 9.

Further, various kinds of fluorescent brightening agent, defoaming agents and surface active agents, polyvinyl pyrrolidone, or organic solvents (e.g., methanol) may be incorporated into the bleach-fixing solution.

The bleach-fixing solution or fixing solution used in the present invention can contain, as preservatives, compounds capable of releasing sulfite ions such as sulfites (e.g., sodium sulfite, potassium sulfite, or ammonium sulfite), bisulfites (e.g., ammonium bisulfite, sodium bisulfite, or potassium bisulfite), or metabisulfites (e.g., potassium metabisulfite, sodium metabisulfite, or ammonium metabisulfite). The amount of such a compound to be added is preferably from about 0.02 mol to about 0.50 mol, and more preferably from 0.04 mol to 0.40 mol per liter of the solution calculated in terms of a sulfite ion.

While it is general to add sulfites as preservatives, other compounds such as ascorbic acid, a carbonyl-bisulfite acid adduct, or a carbonyl compound may be added.

Further, buffers, fluorescent brightening agent, chelating agents, deforming agents, or antimold agents may be added, if desired.

After a silver removing processing such as fixing or bleach-fixing, the silver halide color photographic material according to the present invention is generally subjected to a water washing step and/or a stabilizing step.

An amount of water required for the water washing step may be set in a wide range depending on characteristics of photographic light-sensitive materials (due to elements used therein, for example, couplers), uses thereof, temperature of washing water, a number of water washing tanks (stages), a replenishment system such as countercurrent or orderly current, or other various conditions. A relationship between a number of water washing tanks and an amount of water in a multi-stage countercurrent system can be determined based on the method as described in *Journal of the Society of Motion Picture and Television Engineers,* Vol. 64, pages 248 to 253 (May, 1955). Ordinarily, a number of stages used in the multi-stage countercurrent system is preferably from 2 to 6, particularly from 2 to 4.

According to the multi-stage countercurrent system, the amount of water for washing can be significantly reduced, and the effects of the present invention become remarkable. For example, it is possible to use 0.5 to 1 liter or less of water per $m^2$ of the photographic light-sensitive material. However, increase in staying time of water in a tank causes propagation of bacteria and some problems such as adhesion of floatage formed on the photographic materials occur. In the processing of the silver halide color photographic material according to the present invention, a method for reducing amounts of calcium and magnesium as described in JP-A-62-288838 can be particularly effectively employed in order to solve such problems. Further, sterilizers, for example, isothiazolone compounds and cyabendazoles as described in JP-A-57-8542, chlorine type sterilizers such as sodium chloroisocyanurate as described in JP-A-61-120145, benzotriazoles as described in JP-A-61-267761, copper ions, sterilizers as described in Hiroshi Horiguchi, *Bokin-Bobai No Kagaku* Sankyo Shuppan (1986), *Biseibutsu No Mekkin-, Sakiin-, Bobai-Gijutsu,* edited by Eiseigijutsu Kai (1982), or *Bokin-Bobaizai Jiten,* edited by Nippon Bokin-Bobai Gakkai (1986) can be employed.

Moreover, surface active agents as agents for uniform drying, and chelating agents representatively illustrated by EDTA as water softeners may be employed in washing water.

Following the above described water washing step or directly without conducting the water washing step the color photographic material can be treated with a stabilizing solution. To the stabilizing solution are added compounds having a function of stabilizing images, for example, aldehyde compounds representatively illustrated by formalin, buffers for adjusting pH of layer to a value suitable for stabilization of dyes formed, or ammonium compounds. Further, various sterilizers or antimolds as described above can be employed in the stabilizing solution in order to prevent the propagation of bacteria in the solution and impart antimold property to the photographic material after processing. Moreover, surface active agents, fluorescent whitening agents, or hardener may be added to the stabilizing solution.

The photographic light-sensitive material of the present invention can be directly subjected to stabilizing processing without conducting the water washing step. In such a case, any of known methods as described, for example, in JP-A-57-8543, JP-A-58-14834 and JP-A-60-220345 can be employed.

Further, a chelating agent such as 1-hydroxyethylidene-1,1-diphosphonic acid, or ethylenediaminetetramethylenephosphonic acid, a magnesium compound, or a bismuth compound may be preferably employed.

In the present invention, a rinse solution may also be used as a water washing solution or stabilizing solution employed after the silver removing step.

The pH of washing water or stabilizing solution used in the processing of the photographic light-sensitive material according to the present invention is usually from 4 to 10 and preferably from 5 to 8. The temperature therefor can be set in a wide range depending on characteristics of photographic light-sensitive materials, or uses thereof. It is selected usually in a range from 15° C. to 45° C., preferably from 20° C. to 40° C. The processing time for the step can also be set appropriately, but it is desirable to set the time as short as possible in view of the reduction of processing time. Thus, it is preferably from 15 sec. to 1 min. 45 sec., more preferably from 30 sec. to 1 min. 30 sec.

It is preferred that the amount of replenishment is small in view of the reduction of running cost, the reduction of amount of discharge and associated handling properties.

The specific amount of replenishment is preferably from 0.5 to 50 times, more preferably from 3 to 40 times the amount of processing solution carried over from the preceding bath per unit area of the photographic light-sensitive material. Alternatively, it is not more than 1 liter, preferably not more than 500 ml per $m^2$ of the photographic light-sensitive material. Further, the replenishment can be conducted either continuously or intermittently.

The solutions used in the water washing step and/or stabilizing step can be utilized in preceding steps. For instance, overflow from the washing water in a multistage countercurrent system is introduced into a bleach-fixing bath which is the preceding bath, and a concentrated solution is supplied to the bleach-fixing solution whereby the amount of discharge is reduced.

In accordance with present invention, a silver halide color photographic material which is excellent in color reproducibility and has high sensitivity and a good rapid processing aptitude, and is particularly suitable for a color printing material is provided.

The present invention is now explained in greater detail with reference to the following examples, but the present invention is not to be construed as being limited thereto. Unless otherwise indicated, all parts, percents and ratios are by weight.

Silver halide emulsions used in the following examples were prepared as follows.

25 g of lime-treated gelatin was dissolved in 800 ml of distilled water and 18.8 ml of 1N $H_2SO_4$ and 4.5 g of NaCl were added thereto. To the resulting solution was added 3 ml of a 1% aqueous solution of N,N'-dimethylimidazoline-2-thione, and while maintaining the solution at 60° C., 140 ml of a 3.57% aqueous solution of $AgNO_3$ and 140 ml of a 1.21% aqueous solution of NaCl were added thereto using a double jet method over a period of 10 minutes with vigorous stirring. After 10 minutes, 320 ml of a 37.5% aqueous solution of $AgNO_3$ and 320 ml of an aqueous solution containing 12.1% of NaCl and 0.14% of KBr were added thereto using a double jet method over a period of 25 minutes. The resulting emulsion was flocculated in a conventional manner, washed with water, and then redispersed using of an inert gelatin. The emulsion thus prepared was designated Emulsion A, which had cubic form, an average grain size measured by a coalter counter of 0.80 μm, a coefficient of variation of 12%, and an average silver bromide content of 0.5 mol %.

The above-described emulsion was divided into three, batches (1), (2), and (3). Batch (1) was incorporated with $1\times10^{-5}$ mol of triethylthiourea per mol of silver halide and was subjected to optimum sulfur sensitization at 55° C. The emulsion thus prepared was designated Emulsion B.

Batch (2) was incorporated with $1\times10^{-5}$ mol of triethylthiourea and $2\times10^{-6}$ mol of chloroauric acid, both per mol of silver halide and was subjected to optimum gold and sulfur sensitization at 55° C. The emulsion thus prepared was designated Emulsion C.

Batch (3) was incorporated with $3\times10^{-6}$ mol of chloroauric acid per silver halide and was subjected to optimum gold sensitization at 55° C. The emulsion thus prepared was designated Emulsion D.

Further, to the three emulsions $K_2IrCl_6$ was added in an amount of $1\times10^{-8}$ mol per mol of silver halide during the formation of grains.

EXAMPLE 1

On a white paper support, both surfaces of which were laminated with polyethylene, were coated the layers as shown below in order to prepare a multilayer color printing material which was designated Sample 1. The coating solutions were prepared in the following manner.

Preparation of Coating Solution for First Layer 19.1 g of Yellow coupler (ExY), 4.4 g of Color image stabilizer (Cpd-1) and 0.7 g of Color image stabilizer (Cpd-7) were dissolved in a mixture of 27.2 ml of ethyl acetate and 8.2 ml of Solvent (Solv-1) and the resulting solution was emulsified and dispersed in 185 ml of a 10% aqueous solution of gelatin containing 8 ml of a 10% aqueous solution of sodium dodecylbenzenesulfonate. Separately, to a silver chlorobromide emulsion (Emulsion B) were added two blue-sensitive sensitizing dyes shown below each in an amount of $2.0\times10^{-4}$ mol per mol of silver.

The above described emulsified dispersion was mixed with the silver chlorobromide emulsion, with the concentration of the resulting mixture being controlled to form the composition shown below, whereby the coating solution for the first layer was prepared.

Coating solutions for other layers were prepared in a similar manner to that described for the coating solution for the first layer.

0.10 g/m$^2$ of 1-oxy-3,5-dichloro-s-triazine sodium salt was used as a gelatin hardener in each layer.

The following spectral sensitizing dyes were employed in the emulsion layers, respectively.

Blue-Sensitive Emulsion Layer:

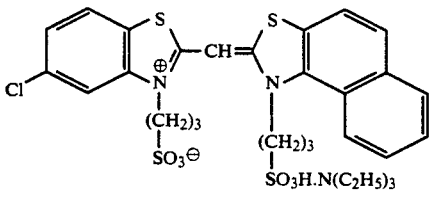

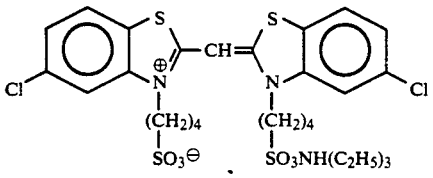

(Amount added: each $2.0\times10^{-4}$ mol per mol of silver halide)

Green-Sensitive Emulsion Layer:

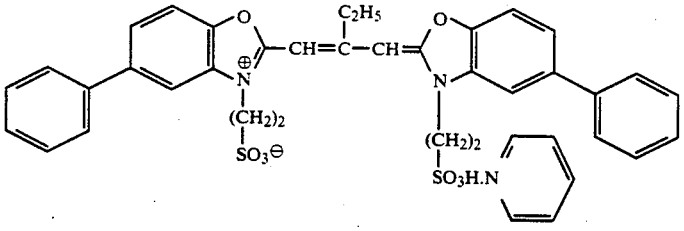

(Amount added: $4.0\times10^{-4}$ mol per mol of silver halide in the larger grain size emulsion and $5.6\times10^{-4}$ mol per mol of silver halide in the smaller grain size emulsion) and

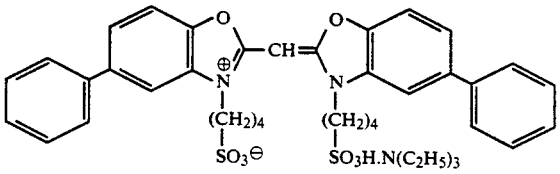

(Amount added: $7.0\times10^{-5}$ mol per mol of silver halide in the larger grain size emulsion and $1.0\times10^{-5}$ mol per mol of silver halide in the smaller grain size emulsion)

Red Sensitive Emulsion Layer:

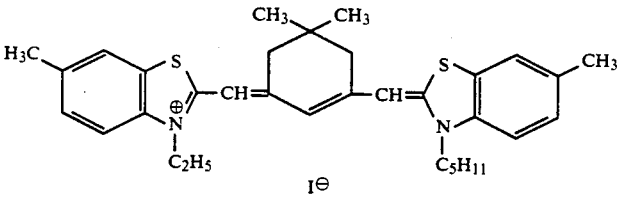

(Amount added: $0.9\times10^{-4}$ mol per mol of silver halide in the larger grain size emulsion and $1.1\times10^{-4}$ mol per mol of silver halide in the smaller grain size emulsion)

To the red-sensitive emulsion layer, was added the compound shown below in an amount of $2.6\times10^{-3}$ mol per mol of silver halide.

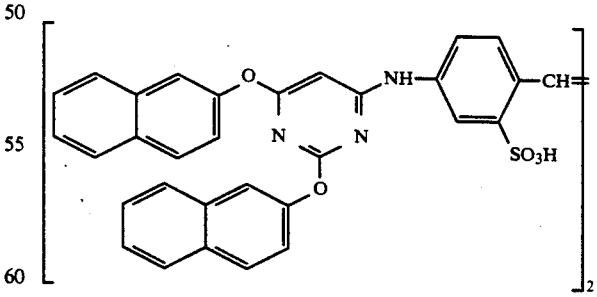

To the blue-sensitive emulsion layer, green-sensitive emulsion layer and red-sensitive emulsion layer, was added 1-(5-methylureidophenyl)-5-mercaptotetrazole in amounts of $8.5\times10^{-5}$ mol, $7.7\times10^{-4}$ mol and $2.5\times10^{-4}$ mol per mol of silver halide, respectively.

Moreover, in order to present irradiation, the following dyes were added to the fourth layer.

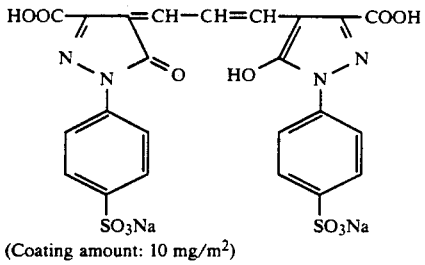

(Coating amount: 10 mg/m$^2$)

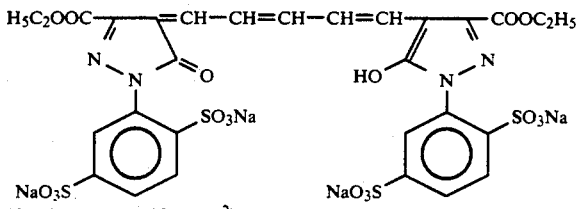

(Coating amount: 15 mg/m$^2$)

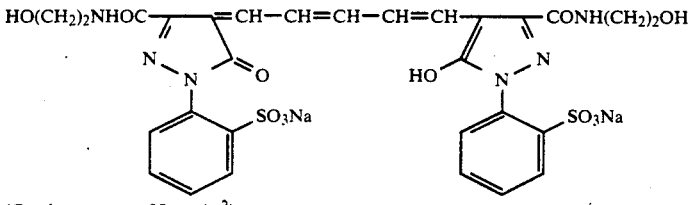

(Coating amount: 35 mg/m$^2$)

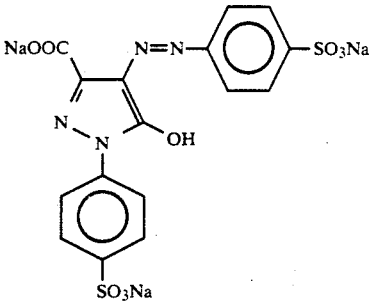

Further, to the blue-sensitive emulsion layer and green-sensitive emulsion layer, was added 4-hydroxy-6-methyl-1,3,3a,7-tetraazaindene in amounts of $1\times10^{-4}$ mol and $2\times10^{-4}$ mol per mol of silver halide, respectively.

Furthermore, the following compounds were employed as antiseptics in the sixth layer.

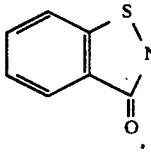

(Coating amount: 25.0 mg/m$^2$)

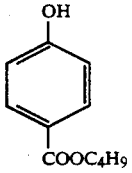

(Coating amount: 50.0 mg/m$^2$)

Layer Construction

The composition of each layer is shown below. The numerical values denote the coating amounts of components in units of g/m$^2$. The coating amount of silver halide emulsion is calculated in terms of silver coating amount.

| | | |
|---|---|---|
| First Layer (Blue-sensitive layer) | Silver chlorobromide emulsion described above | 0.30 |
| | Gelatin | 1.86 |
| | Yellow coupler (ExY) | 0.82 |
| | Color image stabilizer (Cpd-1) | 0.19 |
| | Solvent (Solv-1) | 0.35 |
| | Color image stabilizer (Cpd-7) | 0.06 |
| Second Layer (Color mixing preventing layer) | Gelatin | 0.99 |
| | Color mixing preventing agent (Cpd-5) | 0.08 |
| | Solvent (Solv-1) | 0.16 |
| | Solvent (Solv-4) | 0.08 |
| Third Layer (Green-Sensitive layer) | Silver chlorobromide emulsion (cubic grains, mixture of two emulsions having average grain size of 0.55 μm and 0.39 μm in 1:3 molar ratio of silver, coefficient of variation of grain size: 0.10 and 0.08 | 0.12 |

-continued

| | | |
|---|---|---|
| | respectively, 0.8 mol % silver bromide based on the whole of grains being localized at the surface of grains, respectively) | |
| | Gelatin | 1.24 |
| | Magenta coupler (ExM) | 0.20 |
| | Color image stabilizer (Cpd-2) | 0.03 |
| | Color image stabilizer (Cpd-3) | 0.15 |
| | Color image stabilizer (Cpd-4) | 0.02 |
| | Color image stabilizer (Cpd-9) | 0.02 |
| | Solvent (Solv-2) | 0.40 |
| Fourth Layer (Ultraviolet light absorbing layer) | Gelatin | 1.58 |
| | Ultraviolet light absorbing agent (UV-1) | 0.47 |
| | Color mixing preventing agent (Cpd-5) | 0.05 |
| | Solvent (Solv-5) | 0.24 |
| Fifth Layer (Red-sensitive layer) | Silver chlorobromide emulsion (cubic grains, mixture of two emulsions having average grain size of 0.60 μm and 0.45 μm in 1:4 molar ratio of silver, coefficient of variation of grain size: 0.09 and 0.11 | 0.23 |

-continued

| | | |
|---|---|---|
| | respectively, 0.6 mol % silver bromide based on the whole of grains being localized at the surface of grains) | |
| | Gelatin | 1.34 |
| | Cyan Coupler (ExC) | 0.32 |
| | Color image stabilizer (Cpd-6) | 0.17 |
| | Color image stabilizer (Cpd-7) | 0.40 |
| | Color image stabilizer (Cpd-8) | 0.04 |
| | Solvent (Solv-6) | 0.15 |
| Sixth Layer (Ultraviolet light absorbing layer) | Gelatin | 0.53 |
| | Ultraviolet light absorbing agent (UV-1) | 0.16 |
| | Color mixing preventing agent (Cpd-5) | 0.02 |
| | Solvent (Solv-5) | 0.08 |
| Seventh Layer (Protective layer) | Gelatin | 1.33 |
| | Acryl-modified polyvinyl alcohol copolymer (Degree of modification: 17%) | 0.17 |
| | Liquid paraffin | 0.03 |

The compounds used in the above-described layers had the chemical structures shown below.

Yellow coupler (ExY)
A mixture of

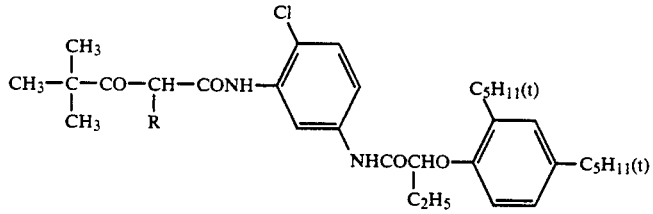

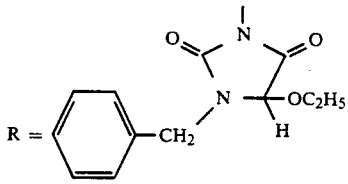

and

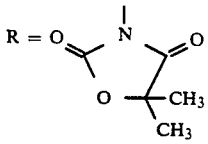

in a molar ratio of 1:1

Magenta coupler (ExM)
A mixture of .

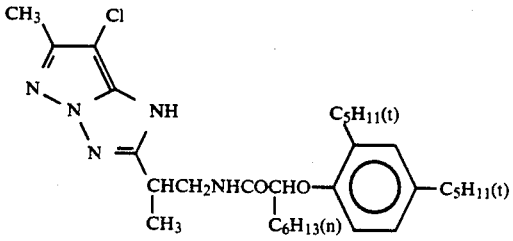

and

-continued
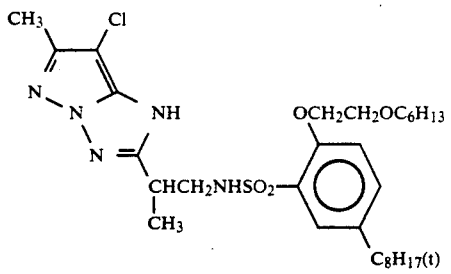
in a molar ratio of 1:1
Cyan coupler (ExC)
A mixture of
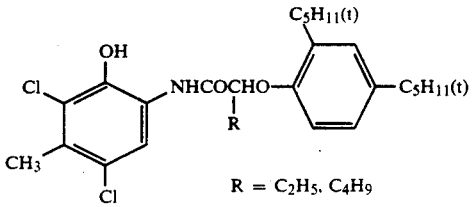
and
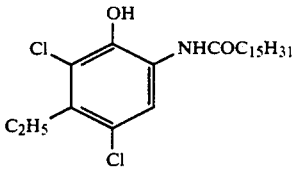
in a weight ratio of 2:4:4
Color image stabilizer (Cpd-1)
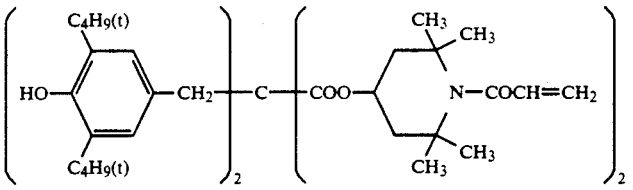
Color Image Stabilizer (Cpd-2)
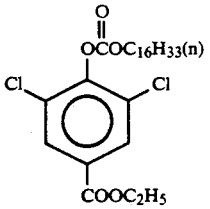
Color image stabilizer (Cpd-3)
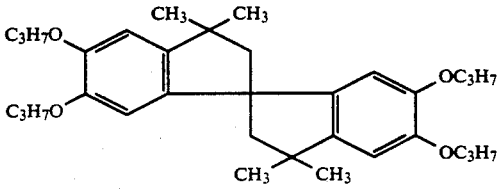
Color image stabilizer (Cpd-4)

-continued
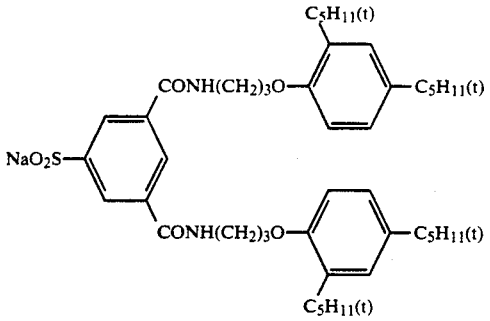
Color mixing preventing agent (Cpd-5)
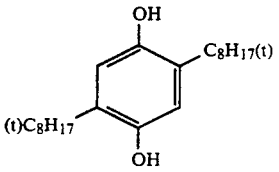
Color Image Stabilizer (Cpd-6)
A mixture of
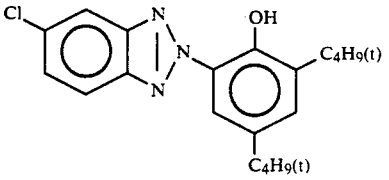
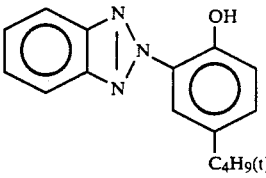
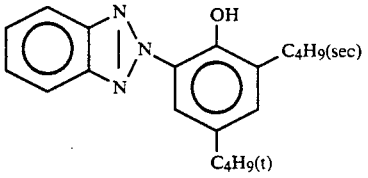
in a weight ratio of 2:4:4
Color Image Stabilizer (Cpd-7)
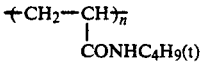
(Average Molecular Weight 60,000)
Color image stabilizer (Cpd-8)
A mixture of
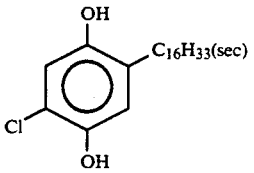
and -continued
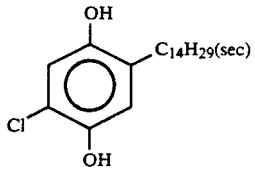
in a weight ratio of 1:1
Color image stabilizer (Cpd-9)
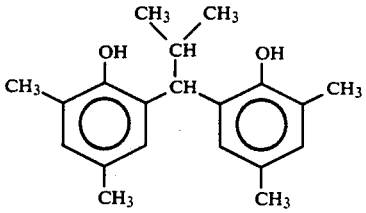
Ultraviolet light absorbing agent (UV-1)
A mixture of
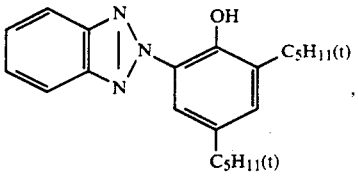
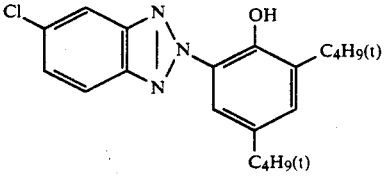
and
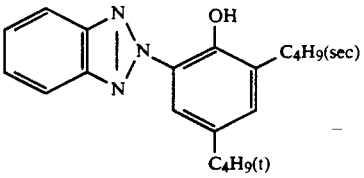
in a weight ratio of 4:2:4
Solvent (Solv-1)
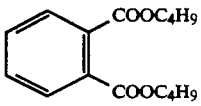
Solvent (Solv-2)
A mixture of
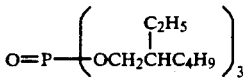
and -continued

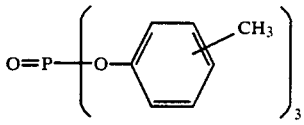

in a volume ratio of 2:1

Solvent (Solv-4)

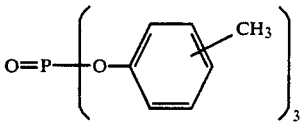

Solvent (Solv-5)

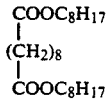

Solvent (Solv-6)
A mixture of

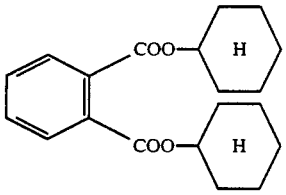

and

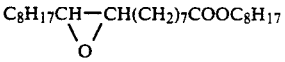

in a ratio of 95:5

In Sample 1, the pH of the coating solution for the first layer was 6.0, the pH of the coating solution for the second layer was 6.6, and the surface pH of Sample 1 was 6.0

Samples 2 to 24 were prepared in the same manner as described for Sample 1 above except for changing the emulsion and yellow coupler used in the first layer (blue-sensitive layer), and changing the surface pH by changing the pH of the coating solutions of the first and second layers with $H_2SO_4$ or NaOH, as shown in Table 1 below, respectively.

In order to evaluate the photographic performance of these samples, the following experiments were conducted.

Each sample was exposed to light so that 30% of the coating amount of silver was developed. The exposed sample was subjected to continuous processing (running test) using a paper processor according to the processing steps described below until the amount of replenishment for color development reached twice the volume of the tank capacity of color development.

Using the fresh processing solutions at the start of the continuous processing and the running resolutions thus obtained, each sample was subjected to sensitometry. Specifically, each sample was subjected to stepwise exposure for sensitometry through blue, green and red filters using a sensitometer (FWH type, produced by Fuji Photo Film Co., Ltd.) equipped with a light source having a color temperature of 3200° K. The amount of exposure was 250 CMS at the exposure time of 1/10 second.

TABLE 1

| No. | Yellow Coupler | Emulsion | Combined pH of Layers | Remark |
|---|---|---|---|---|
| 1 | Ex-Y | B | 6.0 | Comparison |
| 2 | Y-1 | B | 6.0 | " |
| 3 | Ex-Y | C | 4.6 | " |
| 4 | Ex-Y | C | 5.0 | " |
| 5 | Ex-Y | C | 5.5 | " |
| 6 | Ex-Y | C | 6.0 | Comparison |
| 7 | Ex-Y | C | 6.3 | " |
| 8 | Ex-Y | C | 6.5 | " |
| 9 | Ex-Y | C | 6.8 | " |
| 10 | Ex-Y | C | 7.0 | " |
| 11 | Y-1 | C | 4.6 | " |
| 12 | Y-1 | C | 5.0 | Present Invention |
| 13 | Y-1 | C | 5.5 | Present Invention |
| 14 | Y-1 | C | 6.0 | Present Invention |
| 15 | Y-1 | C | 6.3 | Present Invention |
| 16 | Y-1 | C | 6.5 | Present Invention |
| 17 | Y-1 | C | 6.8 | Comparison |
| 18 | Y-1 | C | 7.0 | " |
| 19 | Y-5 | C | 5.5 | Present Invention |
| 20 | Y-5 | C | 6.0 | Present Invention |
| 21 | ExY | D | 6.0 | Comparison |
| 22 | Y-1 | D | 6.0 | Present |

TABLE 1-continued

| No. | Yellow Coupler | Emulsion | Combined pH of Layers | Remark |
|---|---|---|---|---|
| 23 | Y-1 | D | 5.0 | Invention Present |
| 24 | Y-1 | D | 7.0 | Invention Comparison |

| Processing Step | Temperature (°C.) | Time (sec) | Amount of * Replenishment (ml) | Tank Capacity (l) |
|---|---|---|---|---|
| Color Development | 35 | 45 | 161 | 17 |
| Bleach-Fixing | 30–35 | 45 | 215 | 17 |
| Rinse (1) | 30–35 | 20 | — | 10 |
| Rinse (2) | 30–35 | 20 | — | 10 |
| Rinse (3) | 30–35 | 20 | 350 | 10 |
| Drying | 70–80 | 60 | | |

* The amount of replenishment per $m^2$ of photographic light-sensitive material The rinse steps were conducted using a three-tank countercurrent system from Rinse (3) to Rinse (1).

The composition of each processing solution used is shown below.

| | Tank Solution | Replenisher |
|---|---|---|
| Color Developing Solution: | | |
| Water | 800 ml | 800 ml |
| Ethylenediamine-N,N,N',N'-tetramethylenephosphonic acid | 1.5 g | 2.0 g |
| Potassium bromide | 0.015 g | — |
| Triethanolamine | 8.0 g | 12.0 g |
| Sodium chloride | 1.4 g | |
| Potassium carbonate | 25 g | 25 g |
| N-Ethyl-N-(β-methanesulfonamidoethyl)-3-methyl-4-aminoaniline sulfate | 5.0 g | 7.0 g |
| N,N-Bis(carboxymethyl)hydrazine | 5.5 g | 7.0 g |
| Fluorescent brightening agent (WHITEX 4B manufactured by Sumitomo Chemical Co., Ltd.) | 1.0 g | 2.0 g |
| Water to make | 1000 ml | 1000 ml |
| pH (at 25° C.) | 10.05 | 10.45 |
| Bleach-Fixinq Solution: (both tank solution and replenisher) | | |
| Water | 400 ml | |
| Ammonium thiosulfate (70%) | 100 ml | |
| Sodium sulfite | 17 g | |
| Ammonium Iron (III) ethylenediaminetetraacetate | 55 g | |
| Disodium ethylenediaminetetraacetate | 5 g | |
| Ammonium bromide | 40 g | |
| Water to make | 1000 ml | |
| pH (at 25° C.) | 6.0 | |
| Rinse Solution: (both tank solution and replenisher) | | |
| Ion-exchanged water (calcium and magnesium contents: not more than 3 ppm, respectively) | | |

Each sample thus processed was measured for color density to obtain sensitivity and gradation. The sensitivity was defined as the logarithm of the reciprocal of the exposure amount required for obtaining a color density of fog plus 1.5, and the sensitivity of each sample obtained by using the fresh developing solution was taken as 100 and the other sensitivities were shown relatively. The change in fog was shown as the amount of fog density increased by processing with the running solution on the basis of fog density obtained by processing with the fresh developing solution. The gradation was defined as the absolute value of the difference between the reciprocal of the exposure amount required for obtaining a color density of 0.5 and the reciprocal of the exposure amount required for obtaining a color density of 2.0, and the change in gradation was shown as the value increased by processing with the running solution on the basis of the value obtained by processing with the fresh developing solution.

Further, in order to evaluate color reproducibility of the yellow color image obtained in the blue exposure area, the reflective spectrum of the yellow color image at the point having a color density of 1.0 was measured by a spectrophotometer (320 type, produced by Hitachi Co., Ltd.), and a wavelength (λ40) at which the density became 40% of the peak density. The shorter the wavelength, the clearer the reproduction of yellow color that can be achieved.

The results thus obtained are shown in Table 2 below. From the results shown in Table 2 below it can be seen that the decrease in sensitivity and gradation caused by processing with the solution after running when using the yellow coupler according to the present invention can be prevented by employing the silver halide emulsion according to the present invention in combination and adjusting the pH of the layer to the range according to the present invention. A silver halide color photographic material which is excellent in color reproducibility and has high sensitivity and a good rapid processing aptitude can be obtained.

TABLE 2

| Sample No. | Change in Fog | Sensitivity | Change in Gradation | λ40 | Remark |
|---|---|---|---|---|---|
| 1 | 0.02 | 97 | 0.01 | 510 | Comparison |
| 2 | 0.01 | 70 | 0.17 | 501 | " |
| 3 | 0.09 | 94 | 0.10 | 510 | " |
| 4 | 0.10 | 95 | 0.11 | 510 | " |
| 5 | 0.10 | 94 | 0.10 | 510 | " |
| 6 | 0.09 | 96 | 0.12 | 510 | " |
| 7 | 0.10 | 93 | 0.11 | 510 | " |
| 8 | 0.09 | 92 | 0.13 | 510 | " |
| 9 | 0.12 | 92 | 0.14 | 510 | " |
| 10 | 0.14 | 90 | 0.15 | 510 | " |
| 11 | 0.06 | 95 | 0.10 | 501 | " |
| 12 | 0.03 | 96 | 0.04 | 501 | Present Invention |
| 13 | 0.01 | 98 | 0.02 | 501 | Present Invention |
| 14 | 0.02 | 97 | 0.01 | 501 | Present Invention |
| 15 | 0.01 | 97 | 0.02 | 501 | Present Invention |
| 16 | 0.02 | 96 | 0.02 | 501 | Present Invention |
| 17 | 0.07 | 94 | 0.07 | 501 | Comparison |
| 18 | 0.10 | 93 | 0.11 | 501 | " |
| 19 | 0.01 | 97 | 0.02 | 503 | Present Invention |
| 20 | 0.02 | 97 | 0.01 | 503 | Present Invention |
| 21 | 0.10 | 96 | 0.10 | 510 | Comparison |
| 22 | 0.03 | 94 | 0.04 | 501 | Present Invention |
| 23 | 0.02 | 94 | 0.03 | 501 | Present Invention |
| 24 | 0.10 | 80 | 0.12 | 501 | Comparison |

EXAMPLE 2

In the same manner as described in Example 1, continuous processing (running test) was performed using a paper processor according to the processing steps described below, until the amount of replenishment for color development reached twice the volume of the tank capacity of color development. Then, the same procedure as described in Example 1 was conducted. As a result, similar results were obtained.

| Processing Step | Temperature (°C.) | Time (sec) | Amount of * Replenishment (ml) | Tank Capacity (l) |
|---|---|---|---|---|
| Color Development | 35 | 45 | 161 | 17 |
| Bleach-Fixing | 30–36 | 45 | 215 | 17 |
| Stabilizing (1) | 30–37 | 20 | — | 10 |
| Stabilizing (2) | 30–37 | 20 | — | 10 |
| Stabilizing (3) | 30–37 | 20 | — | 10 |
| Stabilizing (4) | 30–37 | 30 | 248 | 10 |
| Drying | 70–85 | 60 | | |

* The amount of replenishment per $m^2$ of photographic light-sensitive material The stabilizing steps were conducted using a four-tank countercurrent system from Stabilizing (4) to Stabilizing (1).

The composition of each processing solution used was as follows:

| | Tank Solution | Replenisher |
|---|---|---|
| Color Developing Solution: | | |
| Water | 800 ml | 800 ml |
| Ethylenediaminetetraacetic acid | 2.0 g | 2.0 g |
| 5,6-Dihydroxybenzene-1,2,4-trisulfonic acid | 0.3 g | 0.3 g |
| Triethanolamine | 8.0 g | 8.0 g |
| Sodium chloride | 1.4 g | — |
| Potassium carbonate | 25 g | 25 g |
| N-Ethyl-N-(β-methanesulfonamidoethyl)-3-methyl-4-aminoaniline sulfate | 5.0 g | 7.0 g |
| Diethylhydroxylamine | 4.2 g | 6.0 g |
| Fluorescent brightening agent (4,4'-diaminostilbene type) | 2.0 g | 2.5 g |
| Water to make | 1000 ml | 1000 ml |
| pH (25° C.) | 10.0.5 | 10.45 |
| Bleach-Fixing Solution: (both tank solution and replenisher) | | |
| Water | 400 ml | |
| Ammonium thiosulfate (70%) | 100 ml | |
| Sodium sulfite | 17 g | |
| Ammonium Iron (III) ethylenediaminetetraacetate | 55 g | |
| Disodium ethylenediaminetetraacetate | 5 g | |
| Glacial acetic acid | 9 g | |
| Water to make | 1000 ml | |
| pH (25° C.) | 5.40 | |
| Stabilizing Solution: (both tank solution and replenisher) | | |
| Formaldehyde (37%) | 0.1 g | |
| Formaldehyde-sulfite adduct | 0.7 g | |
| 5-Chloro-2-methyl-4-isothiazolin-3-one | 0.02 g | |
| 2-Methyl-4-isothiazolin-3-one | 0.01 g | |
| Cupric sulfate | 0.005 g | |
| Water to make | 1000 ml | |
| pH (25° C.) | 4.0 | |

EXAMPLE 3

In order to evaluate the storability of unexposed and unprocessed samples (green samples) of Samples (1) to (24) used in Example 1, the change in photographic properties of each sample was determined after storage at 80% RH for 2 days at 40° C.

Each of the samples exposed and processed with a fresh developing solution in the same manner as in Example 1, was evaluated for change in sensitivity, gradation, and fog during storage, in accordance with the same evaluation method as in Example 1 except that the sensitivity of each sample before storage was taken as 100 and the other sensitivities were shown relatively thereto. The results are shown in Table 3.

TABLE 3

| Sample No. | Change in Fog | Sensitivity | Change in Gradation | λ40 | Remark |
|---|---|---|---|---|---|
| 1 | 0.06 | 95 | 0.10 | 510 | Comparison |
| 2 | 0.04 | 60 | 0.20 | 501 | " |
| 3 | 0.09 | 90 | 0.09 | 510 | " |
| 4 | 0.10 | 92 | 0.09 | 510 | " |
| 5 | 0.12 | 92 | 0.09 | 510 | " |
| 6 | 0.13 | 93 | 0.09 | 510 | Comparison |
| 7 | 0.15 | 93 | 0.09 | 510 | " |
| 8 | 0.15 | 94 | 0.09 | 510 | " |
| 9 | 0.18 | 94 | 0.10 | 510 | " |
| 10 | 0.18 | 95 | 0.10 | 510 | " |
| 11 | 0.04 | 80 | 0.15 | 501 | " |
| 12 | 0.04 | 92 | 0.10 | 501 | Present Invention |
| 13 | 0.06 | 95 | 0.09 | 501 | Present Invention |
| 14 | 0.06 | 96 | 0.08 | 501 | Present Invention |
| 15 | 0.06 | 96 | 0.08 | 501 | Present Invention |
| 16 | 0.0 | 96 | 0.06 | 501 | Present Invention |
| 17 | 0.18 | 97 | 0.06 | 501 | Comparison |
| 18 | 0.18 | 97 | 0.06 | 501 | " |
| 19 | 0.06 | 96 | 0.08 | 503 | Present Invention |
| 20 | 0.06 | 96 | 0.08 | 503 | Present Invention |
| 21 | 0.09 | 92 | 0.10 | 501 | Comparison |
| 22 | 0.08 | 90 | 0.10 | 501 | Present Invention |
| 23 | 0.07 | 90 | 0.09 | 501 | Present Invention |
| 24 | 0.18 | 92 | 0.10 | 501 | Comparison |

The results of Table 3 indicate that the problem that the green samples using the yellow coupler having excellent color reproduction according to the present invention decrease in sensitivity and become soft contrasty and highly fogged during storage, was effectively prevented by combining the emulsions of the present invention and adjusting the surface pH of the layer to the predetermined values of the present invention. Thus the silver halide color photographic materials having excellent color reproduction and excellent storage stability of green samples were obtained in accordance with the present invention.

The samples according to the present invention were tested for the change in sensitivity and gradation at varied humidities at the time of exposure, and the change in sensitivity and gradation of the samples according to the present invention due to the humidity at the time of exposure was very small.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material comprising a support having thereon one or more layers having a surface pH of 5.0 to 6.5, said layers comprising at least one silver halide emulsion layer comprising a silver halide emulsion which is chemically sensitized by at least a gold sensitizer and which has a silver chloride content of at least 90 mol % and at least one coupler represented by formula (I):

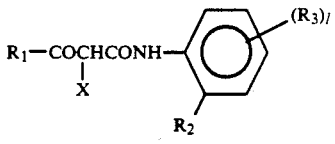

(I)

wherein $R_1$ represents an aryl group or a tertiary alkyl group; $R_2$ represents fluorine, an alkyl group, an aryl group, an alkoxy group, an aryloxy group, a dialkylmaino group, an alkylthio group or an arylthio group; $R_3$ represents a group which is substituted for a hydrogen atom on the benzene ring; X represents hydrogen or a group capable of being cleaved upon a coupling reaction with an oxidation product of an aromatic primary amine developing agent; and l is 0 or an integer of 1 to 4, provided that plural $R_3$ groups may be the same or different.

2. A silver halide color photographic material as claimed in claim 1, wherein R3 is a halogen, an alkyl group, an aryl group, an alkoxy group, an aryloxy group, an alkoxycarbonyl group, an aryloxycarbonyl group, a carbonamido group, a sulfonamido group, a carbamoyl group, an alkylsulfonyl group, an arylsulfonyl group, a ureido group, a sulfamoylamino group, an alkoxycarbonylamino group, a nitro group, a heterocyclic group, a cyano group, an acyl group, an acyloxy group, an alkylsulfonyloxy group, or an arylsulfonyloxy group.

3. A silver halide color photographic material as claimed in claim 1, wherein l represents 1 or 2.

4. A silver halide color photographic material as claimed in claim 1, wherein X represents a halogen atom, a heterocyclic group connected to the coupling active position by a nitrogen atom, an aryloxy group, an arylthio group, an acyloxy group, an alkylsulfonyloxy group, an arylsulfonyloxy group, or a heterocyclic oxy group.

5. A silver halide color photographic material as claimed in claim 3, wherein X represents a substituted or unsubstituted 5-membered to 7-membered heterocyclic group or an aryloxy group.

6. A silver halide color photographic material as claimed in claim 1, wherein $R_1$ is a 2-alkoxyaryl group, a 4-alkoxyaryl group or a tert-butyl group.

7. A silver halide color photographic material as claimed in claim 6, wherein $R_1$ is a tert-butyl group.

8. A silver halide color photographic material as claimed in claim 1, wherein $R_2$ is methyl, ethyl, an alkoxy group, an aryloxy group or a dialkylamino group.

9. A silver halide color photographic material as claimed in claim 8, wherein $R_2$ is an alkoxy group.

10. A silver halide color photographic material as claimed in claim 1, wherein $R_3$ is an alkoxy group, a carbonamido group or a sulfonamido group.

11. A silver halide color photographic material as claimed in claim 5, wherein X is represented by formula (II):

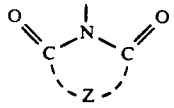

(II)

wherein Z represents

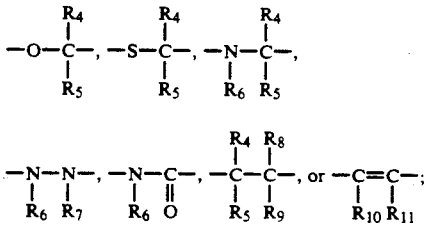

wherein $R_4$, $R_5$, $R_8$ and $R_9$ each represents hydrogen, an alkyl group, an aryl group, an alkoxy group, an aryloxy group, an alkylthio group, an arylthio group, an alkylsulfonyl group, an arylsulfonyl group or an amino group; $R_6$ and $R_7$ each represents a halogen, an alkyl group, an aryl group, an alkylsulfonyl group, an arylsulfonyl group or an alkoxycarbonyl group; $R_{10}$ and $R_{11}$ each represents hydrogen, an alkyl group or an aryl group, and $R_{10}$ and $R_{11}$ may be linked to form a benzene ring; and $R_4$ and $R_5$, $R_5$ and $R_6$, $R_6$ and $R_7$ or $R_4$ and $R_8$ may be linked to form a ring.

12. A silver halide color photographic material as claimed in claim 11, wherein Z represents

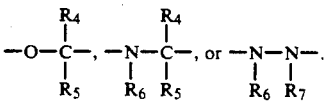

13. A silver halide color photographic material as claimed in claim 1, wherein the coupler is a polymer coupler comprising a yellow dye forming monomer unit represented by formula (III):

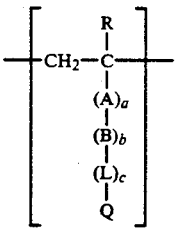

(III)

wherein R represents hydrogen, an alkyl group having from 1 to 4 carbon atoms or chlorine; A represents —CONH—, —COO— or a substituted or unsubstituted phenylene group; B represents a substituted or unsubstituted alkylene group, a substituted or unsubstituted phenylene group or a substituted or unsubstituted aralkylene group; L represents —CONH—, —NHCONH—, —NHCOO—, —NHCO—, —OCONH—, —NH—, —COO—, —OCO—, —CO—, —O—, —$SO_2$—, —$NHSO_2$—, or —$SO_2NH$—; a, b and c each is 0 or 1; and Q represents a yellow coupler moiety formed by removing a hydrogen from $R_1$, X or

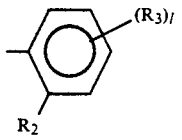

of said compound represented by formula (I).

14. A silver halide color photographic material as claimed in claim 1, wherein the surface pH of said layers is from 5.5 to 6.3.

15. A silver halide color photographic material as claimed in claim 1, wherein the silver halide emulsion has a silver chloride content of at least 95 mol %.

16. A silver halide color photographic material as claimed in claim 1, wherein the silver halide emulsion layer is a blue-sensitive silver halide emulsion layer, comprising said yellow coupler in an amount from $1\times10^{-5}$ to $1\times10^{-2}$ mol/m$^2$, said silver halide color photographic material further comprising at least one green-sensitive silver halide emulsion layer containing at least one magenta coupler and at least one red-sensitive silver halide emulsion layer containing at least one cyan coupler.

17. A silver halide color photographic material as claimed in claim 16, wherein said cyan coupler is represented by formula (C-I) or (C-II):

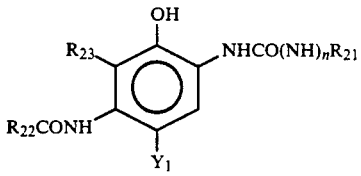

(C-I)

wherein $R_{21}$ and $R_{22}$ each represents a substituted or unsubstituted aliphatic, aromatic or heterocyclic group; $R_{23}$ represents hydrogen, a halogen, an aliphatic group, provided that $R_{22}$ and $R_{23}$ may be linked to form a nitrogen-containing 5-membered or 6-membered ring; $Y_1$ represents hydrogen or a group capable of being released upon a coupling reaction with an oxidation product of a color developing agent; and n is 0 or 1;

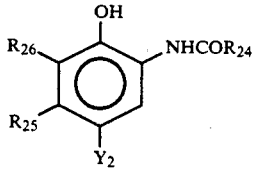

(C-II)

wherein $R_{24}$ represents a substituted or unsubstituted aliphatic, aromatic or heterocyclic group; $R_{25}$ and $R_{26}$ each represents hydrogen, a halogen, an aliphatic group, an aromatic group or an acylamino group; and $Y_2$ represents hydrogen or a group capable of being released upon a coupling reaction with an oxidation product of a color developing agent.

18. A silver halide color photographic material as claimed in claim 16, wherein said magenta coupler is represented by formula (M-I) or (M-II):

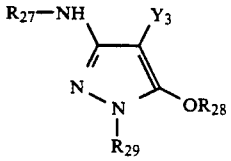

(M-I)

wherein $R_{27}$ and $R_{29}$ each represents an aryl group; $R_{28}$ represents hydrogen, an aliphatic acyl group, an aromatic acyl group, an aliphatic sulfonyl group or an aromatic sulfonyl group; and $Y_3$ represents hydrogen or a coupling-off group;

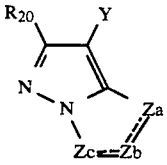

(M-II)

wherein $R_{30}$ represents hydrogen atom; $Y_4$ represents hydrogen or a coupling-off group; Za, Zb and Zc each represents methine, substituted methine, =N— or —NH—, one of said Za—Zb bond and said Zb—Zc bond being a double bond and the other being a single bond; provided that when said Zb—Zc bond is a carbon-carbon double bond, said Zb—Zc bond may be a part of a condensed aromatic ring.

19. A silver halide color photographic material as claimed in claim 15, wherein said silver halide emulsion has a silver chloride content of at least 98 mol %.

20. A silver halide color photographic material as claimed in claim 1, wherein said silver halide emulsion is further chemically sensitized by a sulfur sensitizer.

* * * * *